US010180034B2

(12) United States Patent
Adia et al.

(10) Patent No.: US 10,180,034 B2
(45) Date of Patent: Jan. 15, 2019

(54) CUTTER ELEMENT FOR ROCK REMOVAL APPLICATIONS

(71) Applicant: Element Six Abrasives S.A., Luxembourg (LU)

(72) Inventors: Moosa Mahomed Adia, Springs (ZA); Geoffrey John Davies, Springs (ZA)

(73) Assignee: ELEMENT SIX ABRASIVES S.A., Luxembourg (LU)

( * ) Notice: Subject to any disclaimer, the term of this patent is extended or adjusted under 35 U.S.C. 154(b) by 320 days.

(21) Appl. No.: 14/758,186

(22) PCT Filed: Dec. 23, 2013

(86) PCT No.: PCT/EP2013/077932
§ 371 (c)(1),
(2) Date: Jun. 26, 2015

(87) PCT Pub. No.: WO2014/102248
PCT Pub. Date: Jul. 3, 2014

(65) Prior Publication Data

US 2015/0354286 A1 Dec. 10, 2015

Related U.S. Application Data

(60) Provisional application No. 61/747,790, filed on Dec. 31, 2012.

(30) Foreign Application Priority Data

Dec. 31, 2012 (GB) ..... 1223530.5

(51) Int. Cl.
*E21B 10/56* (2006.01)
*E21B 10/58* (2006.01)
(Continued)

(52) U.S. Cl.
CPC ..... *E21B 10/58* (2013.01); *B24D 3/06* (2013.01); *B24D 18/0009* (2013.01); *E21B 10/567* (2013.01); *E21B 10/573* (2013.01)

(58) Field of Classification Search
CPC ..... E21B 10/46; E21B 10/56; E21B 10/58
See application file for complete search history.

(56) References Cited

U.S. PATENT DOCUMENTS 4,224,380 A * 9/1980 Bovenkerk ..... B01J 3/062 428/545
4,525,178 A * 6/1985 Hall ..... B01J 3/062 51/293

(Continued)

FOREIGN PATENT DOCUMENTS

EP 0573135 A1 12/1993
EP 0573135 B1 5/1998

(Continued)

OTHER PUBLICATIONS

International Search Report for PCT/EP2013/077932 dated Feb. 18, 2015.

(Continued)

*Primary Examiner* — Kenneth L Thompson
(74) *Attorney, Agent, or Firm* — Bryan Cave Leighton PaisnerLLP

(57) ABSTRACT

A cutter element for rock removal comprises a free standing PCD body (801, 1801) comprising one or more physical volumes (1702, 1703), the PCD material being invariant in terms of the diamond and metal network compositional ratio and metal elemental composition such that each physical volume does not differ to any other physical volume with respect to diamond and metal network compositional ratio and metal elemental composition. The PCD body has a functional working volume (803) forming in use the region which comes into contact with the rock. A functional support (Continued)

volume (804) extant in use and having a proximal free surface extends from the functional working volume. The PCD body has an aspect ratio such that the ratio of the length (ae) of the longest edge of the circumscribing rectangular parallelepiped of the overall PCD body to the largest width (ad) of the smallest rectangular face from which the functional working volume extends of the circumscribing rectangular parallelepiped, is greater than or equal to 1.0.

17 Claims, 21 Drawing Sheets

(51) Int. Cl.

| | |
|---|---|
| ***B24D 3/06*** | (2006.01) |
| ***B24D 18/00*** | (2006.01) |
| ***E21B 10/567*** | (2006.01) |
| ***E21B 10/573*** | (2006.01) |

(56) References Cited

U.S. PATENT DOCUMENTS

| | | | | |
|---|---|---|---|---|
| 5,579,856 | A | 12/1996 | Bird et al. | |
| 9,475,176 | B2 * | 10/2016 | Bao | E21B 10/46 |
| 2008/0053710 | A1 | 3/2008 | Moss et al. | |
| 2009/0114454 | A1 | 5/2009 | Belnap et al. | |
| 2010/0326741 | A1 | 12/2010 | Patel et al. | |
| 2011/0036643 | A1 * | 2/2011 | Belnap | C22C 26/00 175/434 |
| 2011/0132667 | A1 | 6/2011 | Smallman et al. | |
| 2012/0097458 | A1 | 4/2012 | Voronin et al. | |
| 2012/0125696 | A1 | 5/2012 | Belnap et al. | |
| 2012/0261196 | A1 * | 10/2012 | Yu | E21B 10/46 175/428 |
| 2015/0060151 | A1 * | 3/2015 | Fang | E21B 10/46 175/430 |
| 2016/0002981 | A1 * | 1/2016 | Adia | E21B 10/567 175/428 |

FOREIGN PATENT DOCUMENTS

| | | | |
|---|---|---|---|
| GB | 2022476 | A | 12/1979 |
| GB | 2502169 | A | 11/2013 |
| GB | 2502170 | A | 11/2013 |
| JP | 62-041778 | A | 2/1987 |
| JP | 05-054696 | U | 7/1993 |
| JP | 2011-149192 | A | 8/2011 |
| JP | 2012-517531 | A | 8/2012 |
| WO | 2008/102324 | A1 | 8/2008 |
| WO | 2011/041693 | A2 | 4/2011 |
| WO | 2011/069637 | A1 | 6/2011 |
| WO | 2011/158190 | A2 | 12/2011 |
| WO | 2012/089566 | A1 | 7/2012 |
| WO | 2012/089567 | A1 | 7/2012 |
| WO | 2013/092883 | A1 | 6/2013 |
| WO | 2013/092896 | A1 | 6/2013 |

OTHER PUBLICATIONS

Search Report for GB1223530.5 dated May 3, 2013.
Search Report for GB1322897.8 dated Jun. 10, 2014.
Bridgman et al; "Effects of High Shearing Stress Combined with High Hydrostatic Pressure", Physical Review; 1935, pp. 825-847; vol. 48.
Brookes et al; "Diamond in Perspective: A Review of Mechanical Properties of Natural Diamond", Diamond and Related Materials; 1991; pp. 3-17; vol. 1.
Brookes et al; "The Plasticity of Diamond", Jun. 1992; pp. 1-130.
Hibbs et al; "Some Aspects of the Wear of Polycrystalline Diamond Tools in Rock Removal Processes", Elsevier Sequoia, 1978, pp. 141-147; vol. 46.
Prakash et al; "Finite Element Method for Temperature Distribution in Synthetic Diamond Cutters During Orthogonal Rock Cutting"; 1986; pp. 1-153.
International Search Report for PCT/EP2013/077936 dated Feb. 12, 2015.
Search Report for GB1223528.9 dated Apr. 15, 2013.
Search Report for GB1322899.4 dated Jun. 10, 2014.

* cited by examiner

CUTTER ELEMENT FOR ROCK REMOVAL APPLICATIONS

This disclosure relates to cutter elements formed of structures or bodies comprising polycrystalline diamond containing material, methods of making such cutter elements and to elements or constructions comprising polycrystalline diamond structures intended for applications where geological rock and construction materials, such as concrete, asphalt and the like, are broken down and removed. Such applications include oil well drilling, road planning, mining, building construction and the like.

Polycrystalline diamond materials (PCD) as considered in this disclosure are illustrated schematically in FIG. 1, and consist of an intergrown network of diamond grains, 101, with an interpenetrating metallic network, 102. The network of diamond grains is formed by sintering of diamond powders facilitated by molten metal catalyst/solvent for carbon at elevated pressures and temperatures. The molten metal catalysts/solvents for carbon allow partial recrystallisation of the diamond to occur, the newly crystallized diamond forming diamond bonding of each diamond particle to its neighbors, 103. The diamond powders may have a monomodal size distribution whereby there is a single maximum in the particle number or mass size distribution, which leads to a monomodal grain size distribution in the diamond network. Alternatively, the diamond powders may have a multimodal size distribution where there are two or more maxima in the particle number or mass size distribution, which leads to a multimodal grain size distribution in the diamond network. Typical pressures used in this process are in the range of around 4 to 7 GPa but higher pressures up to 10 GPa or more are also practically accessible and can be used. The temperatures employed are above the melting point at such pressures of the metals. The metallic network is the result of the molten metal freezing on return to normal room conditions and will inevitably be a high carbon content alloy. In principle, any molten metal solvent for carbon which can enable diamond crystallization at such conditions may be employed. The transition metals of the periodic table and their alloys may be included in such metals. PCD materials as defined above having interpenetrating networks of polycrystalline diamond and metal also include the possibility of the presence of one or more extra phases of materials such as ceramics or carbides. These extra phases may take the form of a third polycrystalline network or may be separate particles included in either the diamond or metal or metallic networks. Examples of such extra phases of materials include the oxide ceramics such alumina, zirconia and the like, and also carbide such as silicon carbide, tungsten carbide and generally transition metal carbide, and the like.

Conventionally, the predominant custom and practice in the prior art is to use the binder metal of hard metal substrates caused to infiltrate into an adjacent mass of diamond powder, after melting of such binders at the elevated temperature and pressure. The PCD material created in this way forms a layer bonded to the hard metal substrate during the high pressure high temperature sintering process. This is infiltration of molten metal at the macroscopic scale of the mass of diamond powder leading to the conventional PCD layer being bonded to the substrate, i.e., infiltrating at the scale of millimeters. By far the most common process in the prior art includes the use of tungsten carbide, with cobalt metal binders as the hard metal substrate. This inevitably results in the hard metal substrate being bonded in-situ to the resultant PCD. Successful commercial exploitation of PCD materials to date has been very heavily dominated by such custom and practice.

For the purposes of this disclosure, PCD constructions which use hard metal substrates as a source of the molten metal sintering agent via directional infiltration and the bonding in-situ to that substrate are referred to as "conventional PCD" constructions or bodies. Such a conventional PCD construction is illustrated in FIG. 2, which shows a layer of PCD material, 201, bonded to a hard metal substrate, 202. The PCD layer conventionally is of limited thickness, 203, typically up to about 2.5 mm. The molten metal required as a catalyst solvent for the partial crystallization of the diamond powder of the PCD layer is sourced in the hard metal substrate and directionally infiltrates into the diamond powder layer over its full scale of thickness, as indicated by the arrows, 204.

Historically, conventional PCD structures consisting of PCD material bonded and attached to carbide hard metal substrates are used for material removal elements attached and arranged in housing bodies. General applications where the material to be removed is rock include drill bits for oil well and mining purposes and the like. Applications such as road planing and building construction are included, where the material to be removed may be considered as synthetic or re-constituted rock-like materials such as asphalt, rock chipping containing asphalt, concrete, brick and the like, including combinations of such. Henceforth, as used herein the term "rock" will be considered to refer to both natural geological rocks and synthetic or re-constituted rock-like materials.

Very important applications such as oil well drilling use two main streams of drilling technology, either in competition with or complementing each other. These are drag bit and roller cone technologies. Both of these technologies exploit conventional PCD structures.

FIG. 3 is a schematic diagram of a typical drag bit, 301, and housing body, 302. The diagram shows conventional PCD rock removal elements 303, 304, and 305 in different radial positions in the housing body, consisting of right circular cylinders comprising relatively thin layers of PCD material bonded and attached to much larger carbide hard metal cylindrical substrates. On rotation of the drill bit, such elements are caused to continuously bear on the rock and operate by a predominantly shearing action, where the rock is progressively fractured and fragmented. FIG. 4 shows one edge of a conventional PCD rock cutting element, 401, continuously shearing rock, 402.

FIG. 5 is a schematic diagram of a typical roller cone drill bit, 501, consisting of a housing body, 502, and three roller cone structures, 503, which are able to freely rotate on bearings. Each roller cone, 503, rotates around the surface of the rock as the overall drill bit housing body, 502, is rotated. The rock removal elements or bodies, 504, are inserted and attached to the surface of each of the three cone structures. As the cone structures turn, they bring the rock removing elements sequentially to bear on the rock surface. The roller cone structures are attached to the housing body via shaft and bearing structures which are in turn protected by gage pad surfaces, 505, with abrasion resistant gage elements, 506. Water cooling and crushed rock removal is facilitated by nozzles, 507. In this case the rock removing elements, 504, have typically rounded ends such as general chisel shapes, or domed and/or conical surfaces which bear upon the rock surface. These rock removal elements typically have a relatively thin PCD material layer bonded with the shaped hard metal substrate, and remove rock by a predominantly crushing action. This is illustrated in FIG. 6 which shows a cross-section of dome shaped conventional PCD crushing element, 601, consisting of a thin layer of PCD material, 602, forming a shell bonded to a dome shaped hard metal body, 603, bearing and crushing rock, 604.

Conventional rock removal elements exhibit a series of limitations and problems during the rock removal applications which originate and follow from the use of large hard metal substrates as the dominant source of the metal network of the PCD material and that the said PCD material forms a layer bonded to the hard metal substrate during the manufacturing procedures. The two important considerations to do with the performance and useful life of rock removal elements are the wear progression characteristics of the PCD layers and its fracture related failure.

The first life limiting consideration is the wear characteristic of conventional rock removal elements in that, due to the limited PCD layer thickness, any developing wear scar extends into the hard metal substrate material, no matter what the shape of the rock removal element. Typical PCD material layer thicknesses in prior art conventional rock removing elements are in the range 0.5 mm to 2.5 mm. In such circumstances, the limited thickness of the PCD layer leads to the stage of wear where the wear scar extends into the hard metal substrate to occur for a limited degree of overall wear of the rock removal element. Because hard metal materials are far inferior to PCD in terms of all aspects of wear, several wear related phenomena arise which causes problems in the use of conventional rock removal elements. In particular, preferential removal of the hard metal substrate material leads to undercutting of the PCD layer which is now mechanically and thermally unsupported. In turn, this leads to the potential for increased local bending stresses on the PCD layer, which engenders fracture, and increases in local temperature in the PCD layer, which engenders thermal degradation and a very rapid decrease in wear resistance.

The second life limiting consideration is the potential for early fracture of the PCD layer which is an outcome of easy crack initiation and propagation in the PCD layer, leading to chipping and catastrophic spalling. Spalling occurs when the PCD layer wholly or in substantial part breaks away. This is as a result of cracks propagating to the free surface of the PCD layer. Such fracture behaviour is readily engendered by unavoidable macroscopic (extending across the overall dimensions of the rock removal element) residual stress involving significant tensile components inherent in conventional PCD rock removal elements. For a rock cutting element comprising a PCD layer bonded at one end of a right cylindrical carbide substrate, there are significant axial, radial and hoop residual tensile stresses in the PCD layer at a peripheral top edge of the element. This is schematically illustrated in FIG. 7, which presents a part cross section of a conventional PCD rock removing element, with centre line, 701, PCD layer, 702, and hard metal substrate, 703. The diagram shows regions of high tensile stress, 704, at the free surface of the PCD layer, 702, the bulk of the PCD layer being in general compression. The origin of such damaging residual stress distributions in the PCD layers is to be found predominantly in the differential thermal expansion between the PCD and the bonded hard metal substrate experienced in the element during the return to room temperature and pressure conditions in the manufacturing procedures. The aspect of deleterious macroscopic residual stress distributions in conventional, carbide substrate supported PCD bodies or elements is described in detail in patent applications reference 1, U.S. Ser. No. 61/578,726 (British Patent Application, GB 1122064.7), reference 2, U.S. Ser. No. 61/578,734 (British Patent Application, GB 1122066.2), references 3 and 4, International Patent Applications published as WO2012/089566 and WO2012/089567, respectively.

In conventional rock removing PCD elements, the carbide substrate often suffers from erosion greater than that of the layer of PCD material, resulting in undercutting and loss of support to the PCD layer and consequential fracture of that layer. Advantages are therefore to be expected if the erosion resistance of the material mechanically supporting the PCD layer is increased.

Another important function of the material supporting the PCD layer is to act as a thermal heat sink and conduit for the removal of heat from the PCD layer. It is important to maintain the temperature of the PCD layer below certain critical levels above which very damaging thermal degradation mechanisms can occur. Clearly, increasing the thermal conductivity of the material of that supports the PCD layer can be advantageous.

There is therefore a need for a cutter element and method of producing a cutter element that ameliorates or substantially eliminates the above problems.

Viewed from a first aspect there is provided a cutter element for rock removal comprising:

a free standing PCD body comprising an inter penetrating network of diamond and metal, the free standing PCD body further comprising:

a) one or more physical volumes within the boundary of the PCD body, wherein the PCD material for the whole body is invariant in terms of the diamond and metal network compositional ratio and metal elemental composition, such that each physical volume does not differ to any other physical volume with respect to diamond and metal network compositional ratio and metal elemental composition;

b) a functional working volume distal to the PCD body, the functional working volume forming in use the region or volume which comes into contact with the rock and causing progressive removal of the rock by a combination of shearing, crushing and grinding and itself is progressively worn away during the lifetime of the PCD body; and c) a functional support volume extant in use and having a proximal free surface, the functional support volume being a region or volume extending from the functional working volume and providing mechanical and thermal support to the functional working volume together with the means of attachment of the rock removal PCD body to the housing body;

d) the functional working volume extending from a distal free surface or boundary between adjacent free surfaces comprising any combination of edges, vertices, convex curved surfaces or protrusions, with an increase in cross-sectional area in the functional working volume extending into the functional support volume, along the line of extension from the distal extremity of the functional working volume, through the centroid of the overall body to the proximal extremity of the functional support volume;

e) wherein the functional support volume encompasses the centroid of the overall free standing PCD body;

f) the overall PCD body having a shape having an aspect ratio such that the ratio of the length of the longest edge of the circumscribing rectangular parallelepiped of the overall PCD body to the largest width of the smallest rectangular face from which the functional working volume extends of the circumscribing rectangular parallelepiped, is greater than or equal to 1.0;

g) wherein the free standing PCD body is macro stress free, having an absence of residual stress at a scale greater than ten times the average grain size, where the coarsest component of grain size is no greater than three times the average grain size.

Viewed from a second aspect there is provided a method for producing the above-defined cutter element wherein the PCD body comprises one or more physical volumes, each a preselected combination of intergrown diamond grains of specific average grain size and size distribution with an independently preselected interpenetrating metallic network of specific atomic composition with an independently preselected overall metal to diamond ratio, the method comprising the steps of:

a) forming a mass of combined diamond particles and metallic material for each physical volume, where said mass is the sole source of metal required for diamond particle to particle bonding via partial diamond re-crystallization;

b) consolidating each mass of diamond particles and metallic materials to generate separate cohesive green bodies of pre-selected size and 3-dimensional shape and assembling them into an overall cohesive green body, or sequentially consolidating each mass to generate an overall cohesive green body of pre-selected size and 3-dimensional shape; and c) subjecting the overall green body to high pressure and high temperature conditions such that the metal material wholly or in part becomes molten and facilitates diamond particle to particle bonding.

Embodiments will now be described by way of example only and with reference to the accompanying drawings in which.

Figure 10:
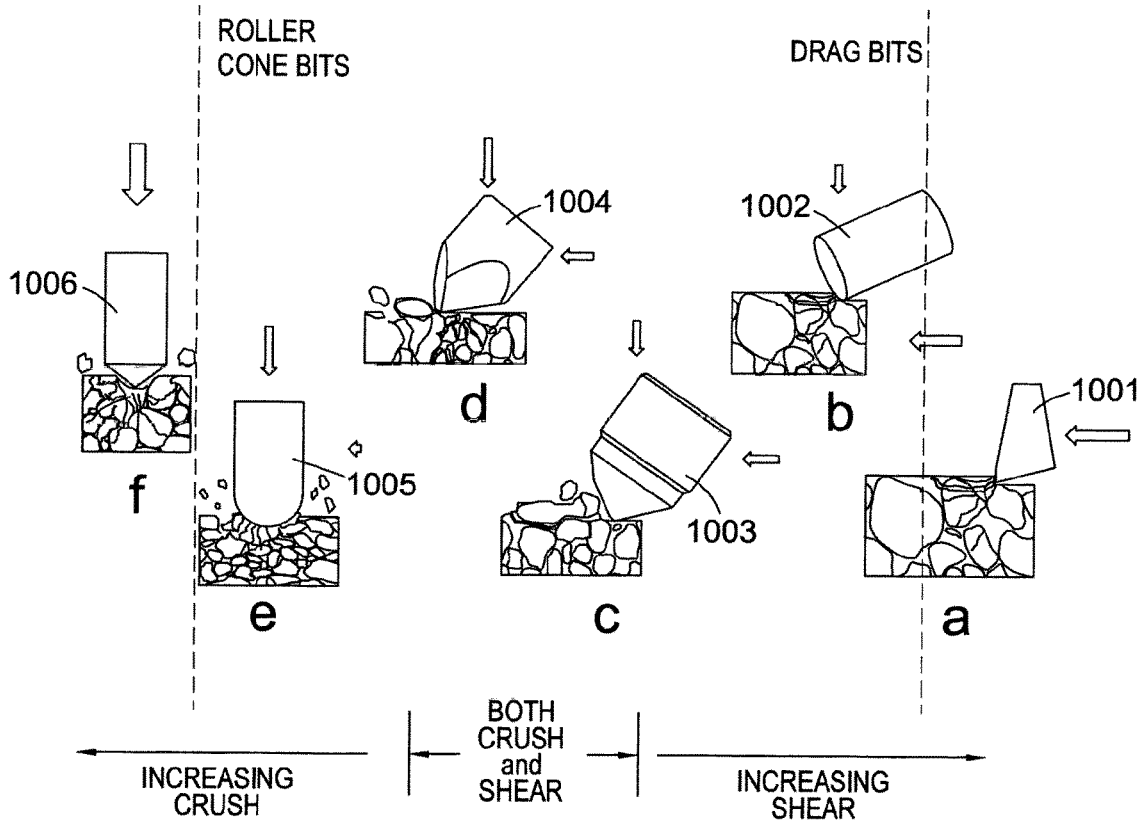
Figures 11A, 11B, 11C:
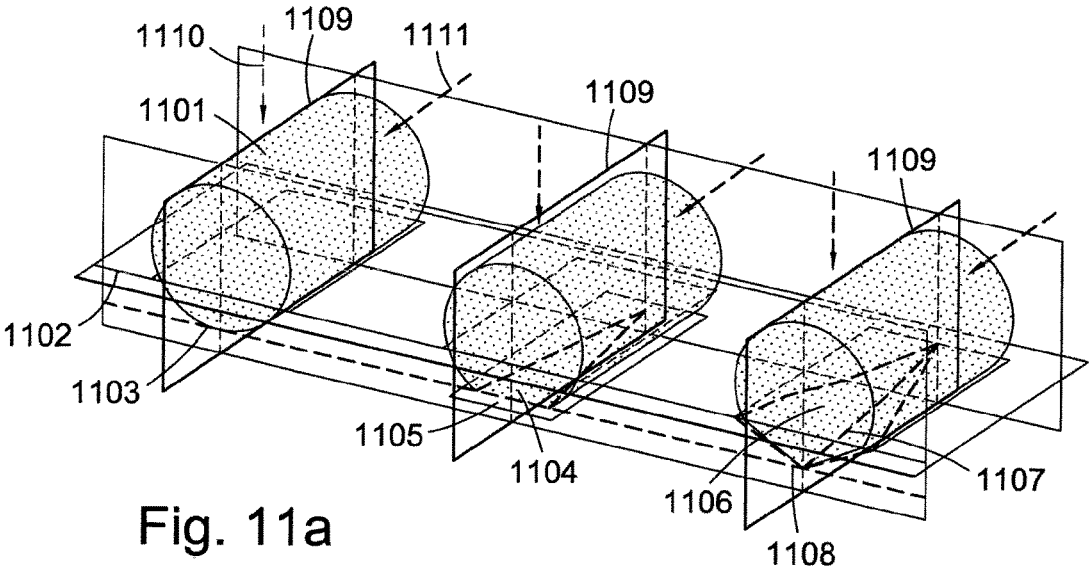
Figure 12A:
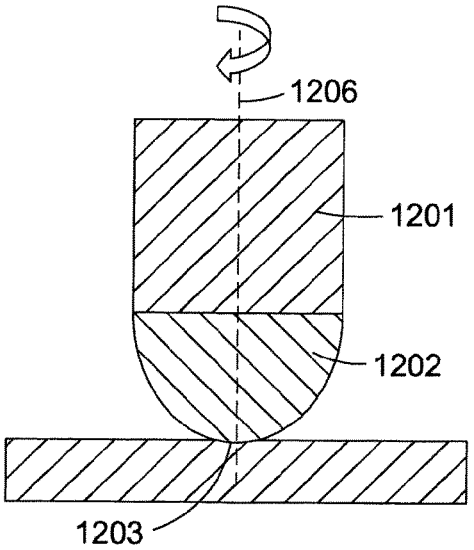
Figure 12B:
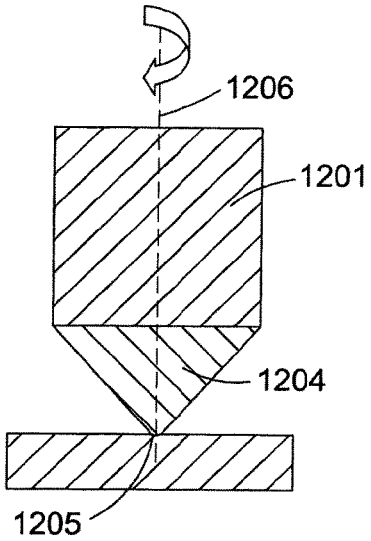
Figure 13A:
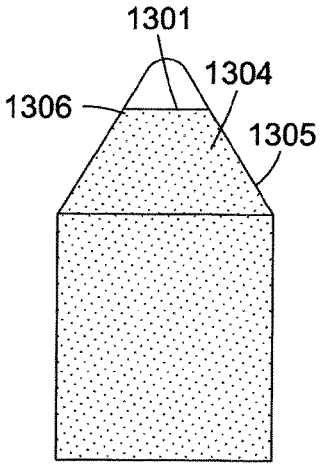
Figure 13B:
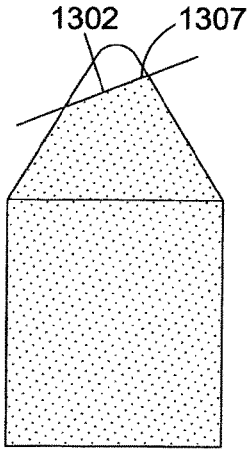
Figure 13C:
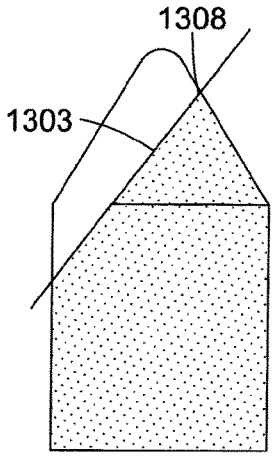
Figure 14A:
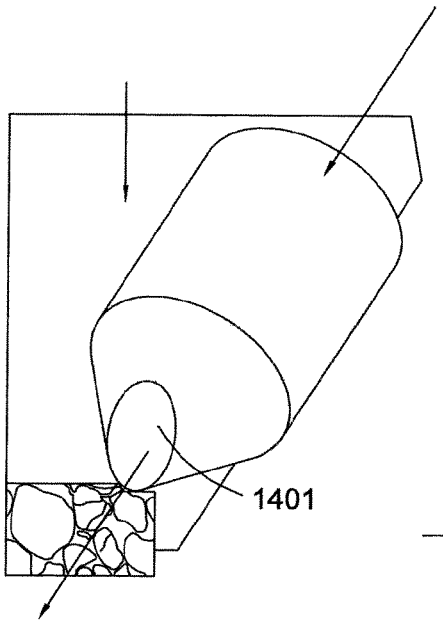
Figure 14B:
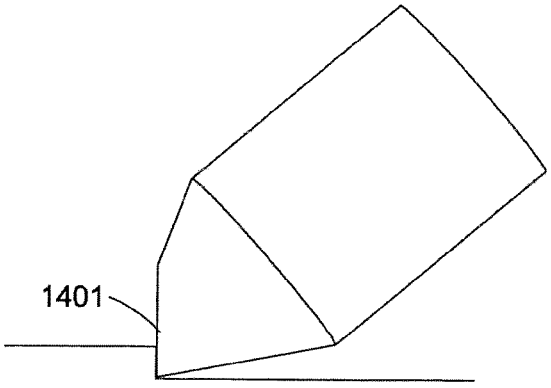
Figures 16A, 16B:
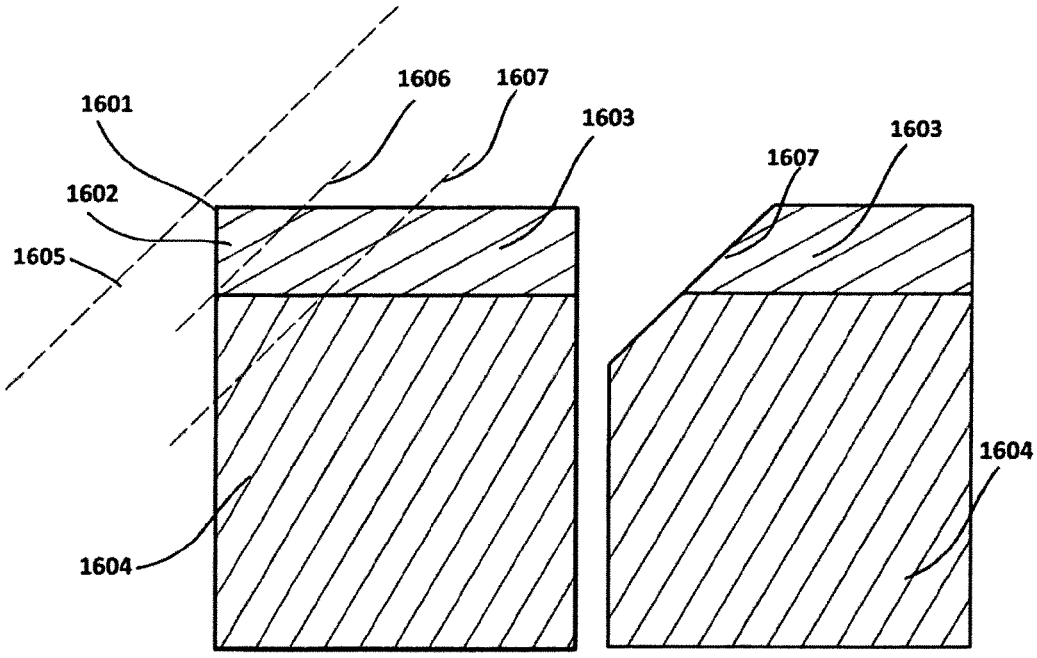
Figure 17:
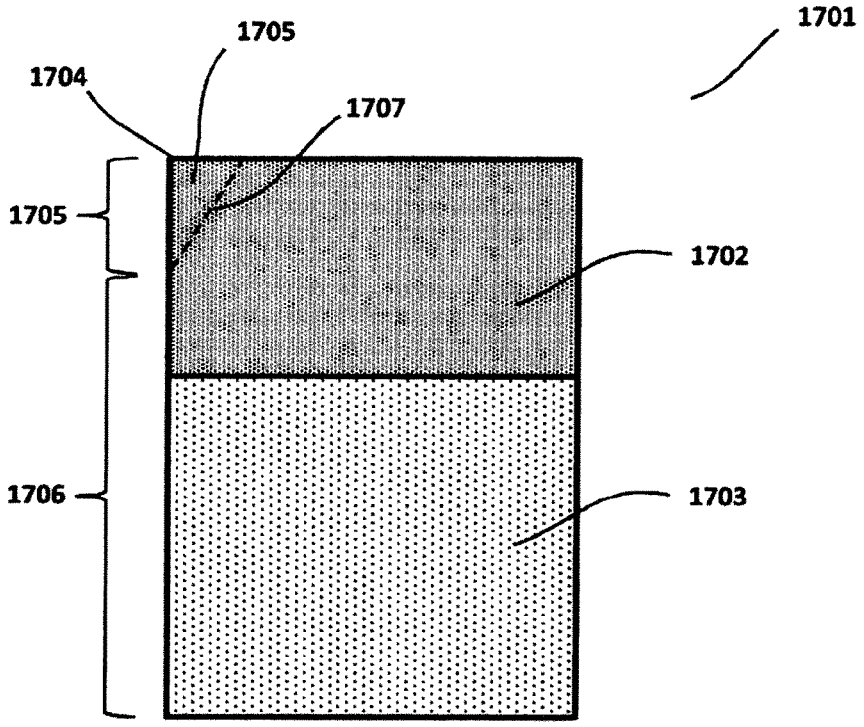
Figure 18:
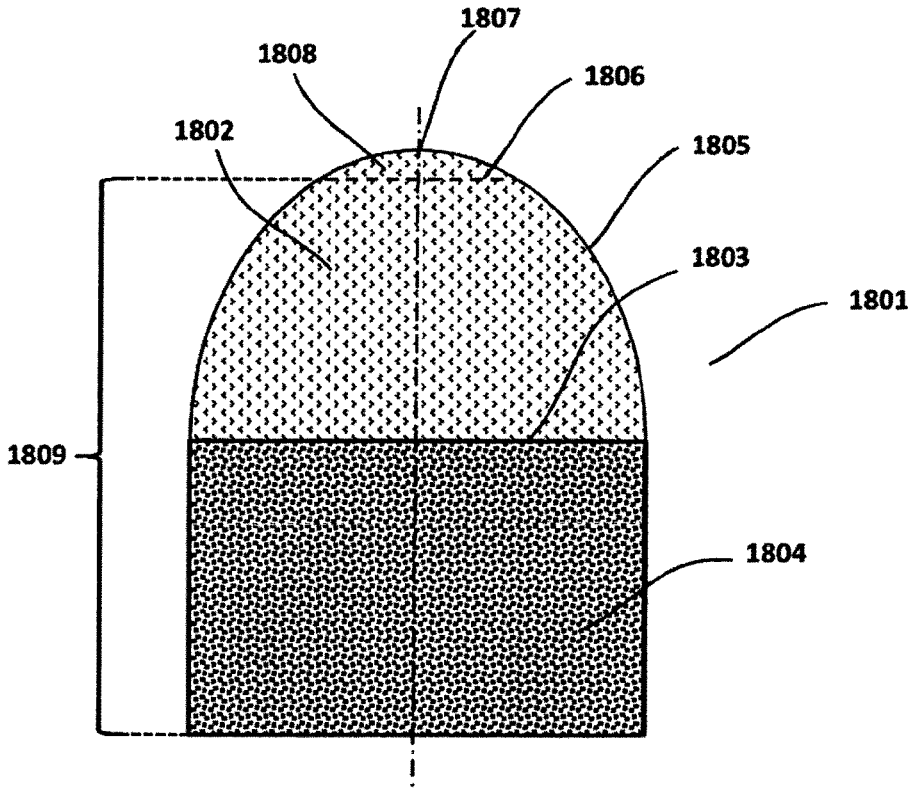
Figures 19A, 19B:
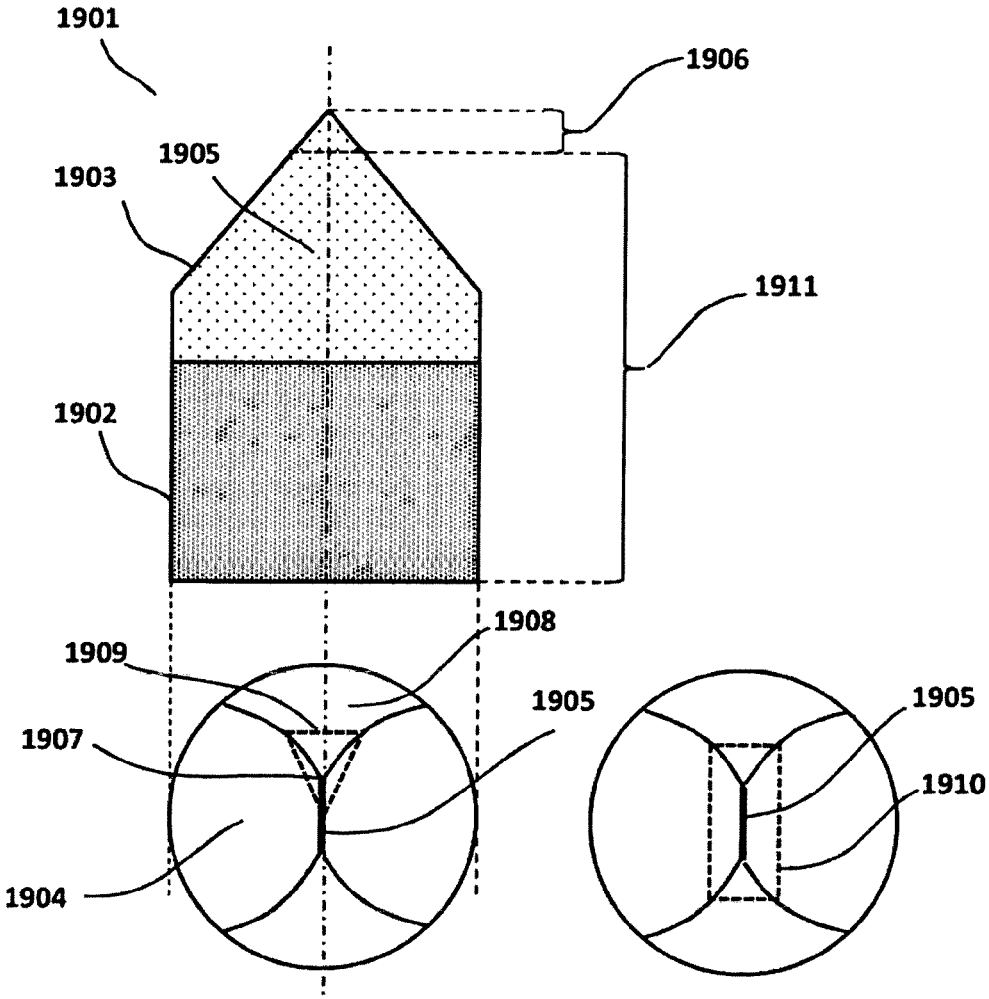
Figure 20:
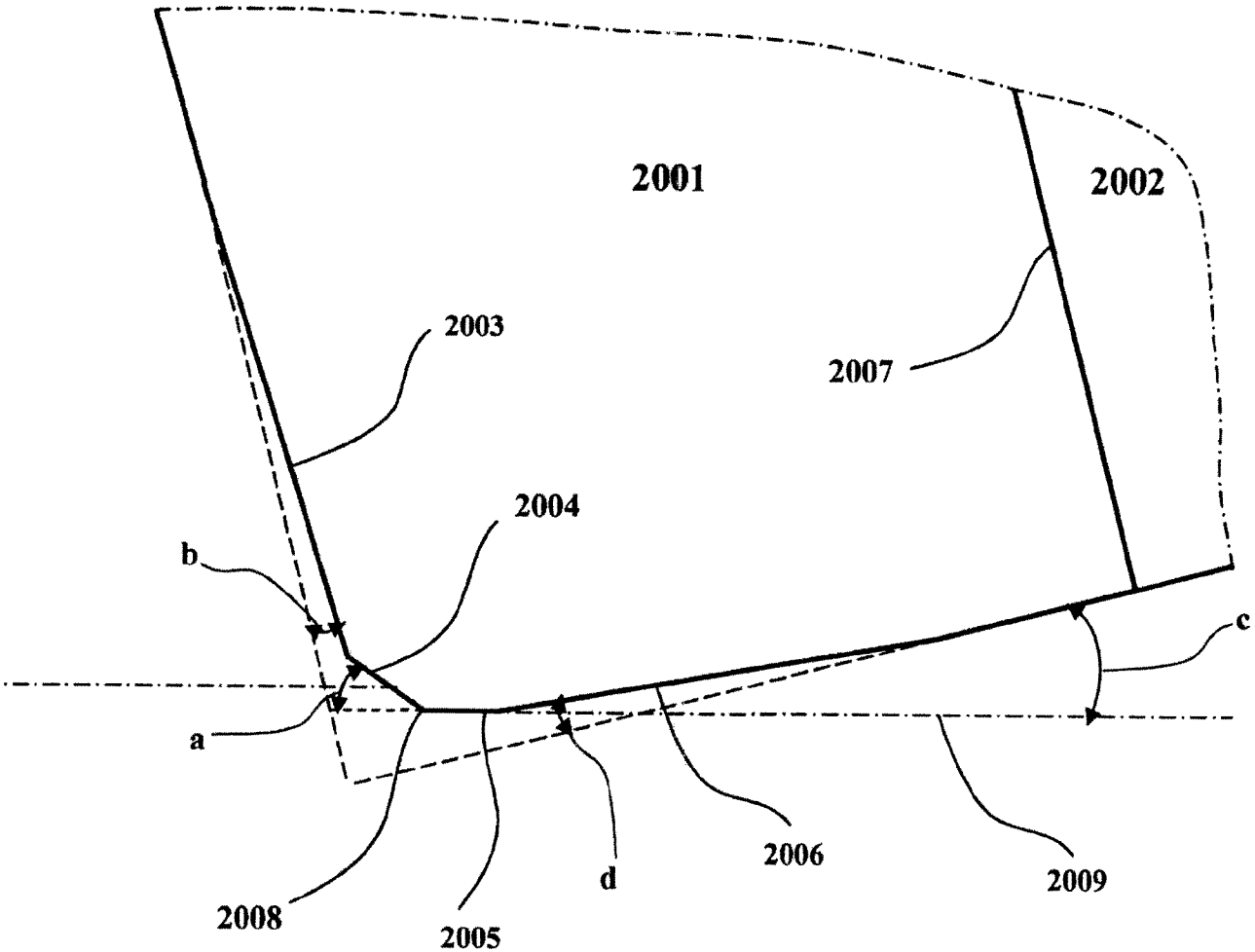
Figure 21:
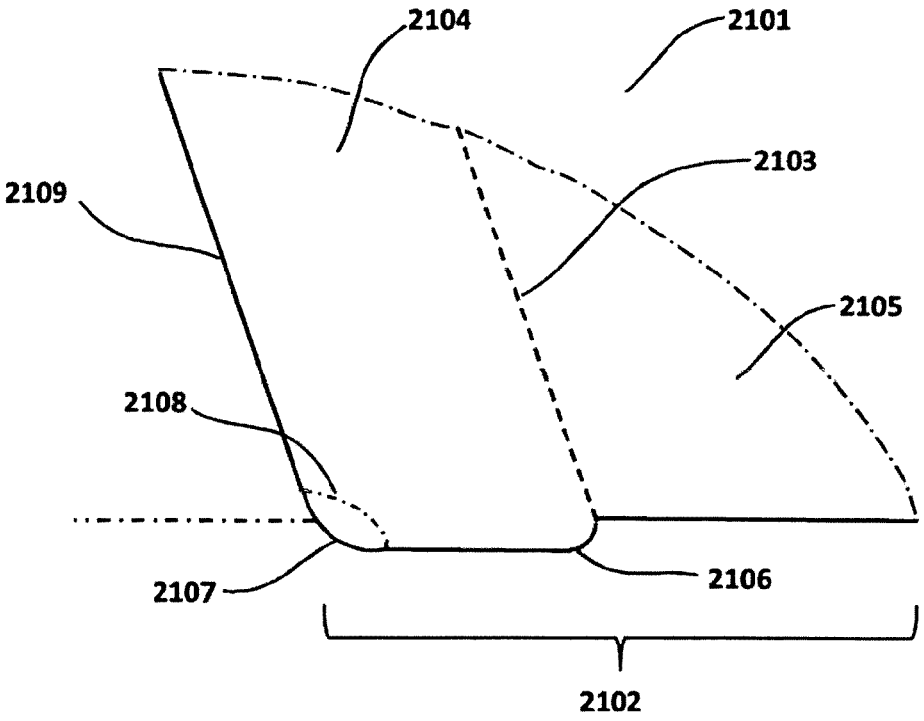
Figure 22:
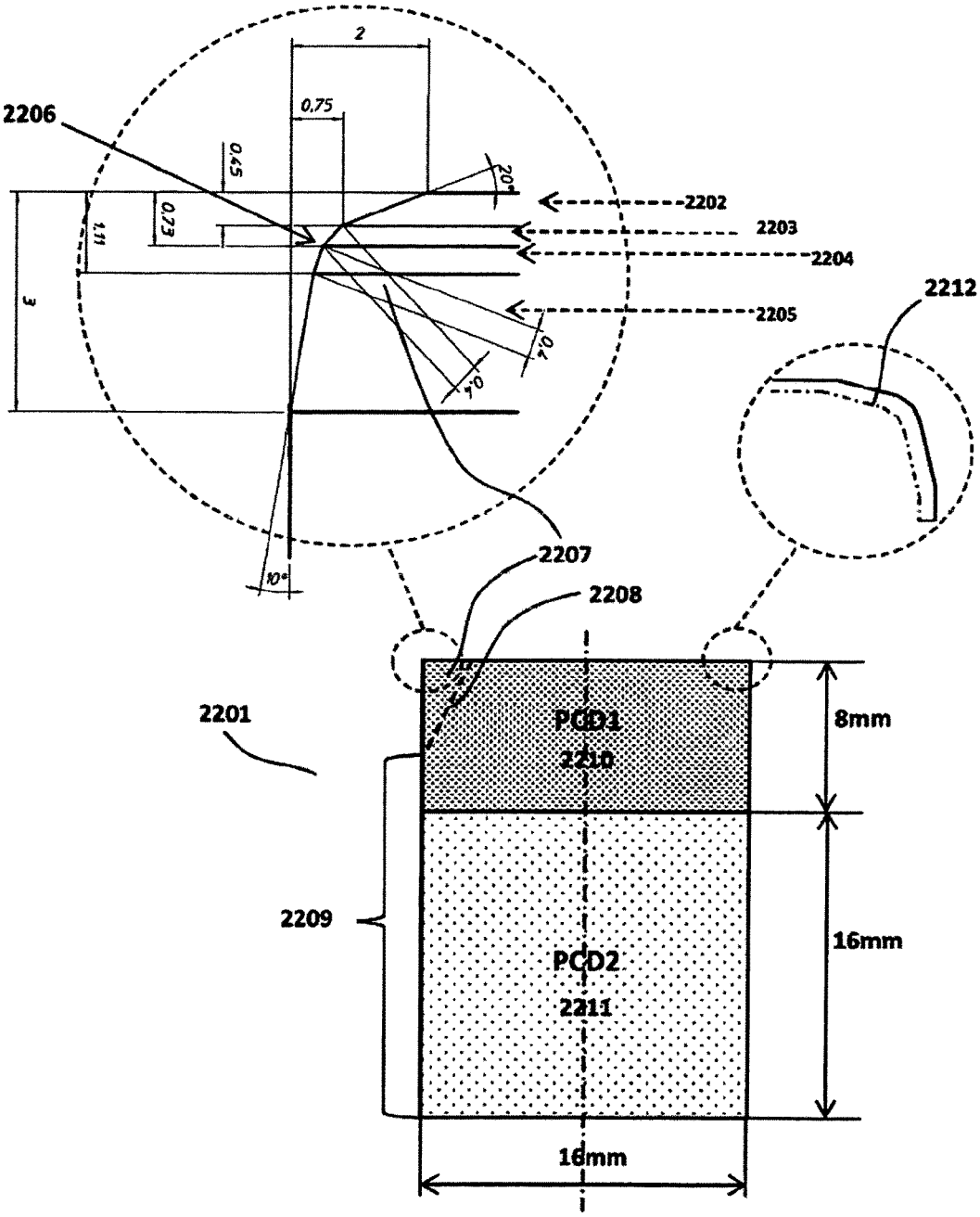
Figure 23:
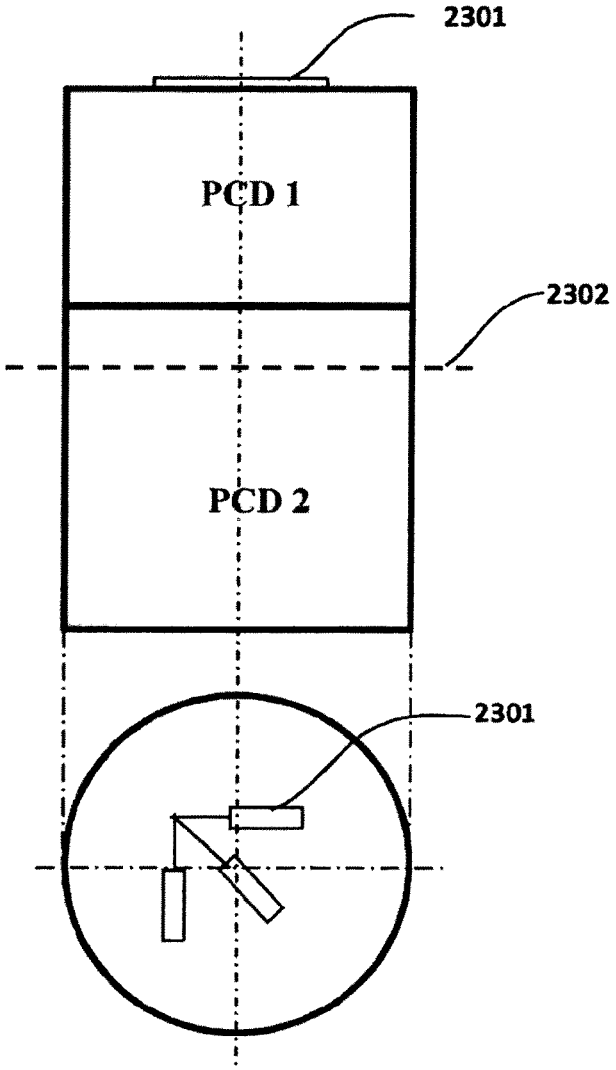
Figure 24:
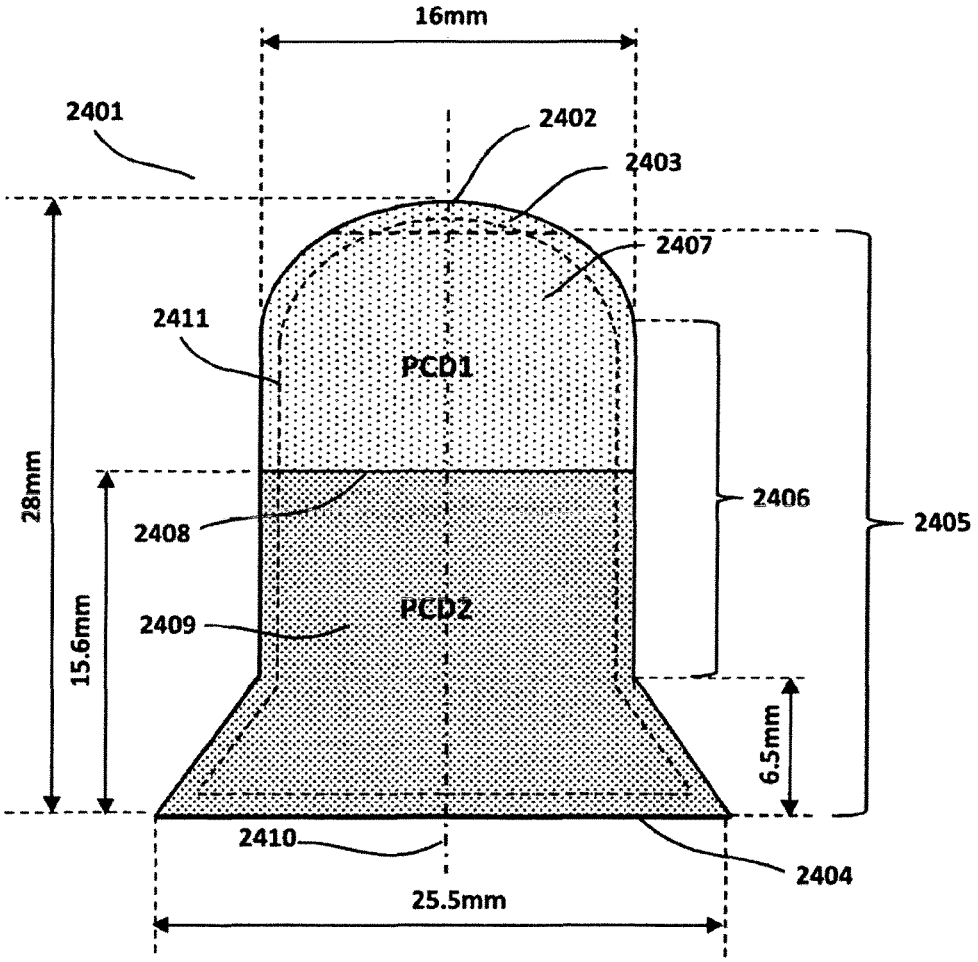

FIGS. 10*a* to *f* schematically depict the range of rock removal modes from pure shear at FIG. 10*a* to pure crushing at FIG. 10*f* and indicates how rock removal elements or bodies can fracture rock with respect to the relative vertical (or normal) and lateral (or tangential) forces applied to the rock removal elements or bodies;

FIGS. 11*a, b* and *c* are examples of mirror planes extending from distal extremities of the functional working volumes of free standing PCD bodies based on a right cylinder predominantly intended for shearing rock, where the distal extremities are a curved edge, a straight edge and a vertex, respectively, showing that the mirror plane of symmetry corresponds to the plane determined by the vertical and tangential components of the applied force;

FIGS. 12*a* and 12*b* are illustrations of examples of dome-ended and chisel-ended embodiments of PCD rock removal inserts or bodies for the general case of rock removal inserts intended for predominantly crushing the rock, exhibiting n-fold axes of rotational symmetry through the distal extremities of the functional working volumes;

FIGS. 13*a, b* and *c* are examples where flat surfaces truncate a conical working volume where the distal extremity of the working volume may be chosen to be a position on the curved edge which bounds the flat truncation facet and the curved surface of the cone;

FIGS. 14*a* and *b* shows how the embodiments of FIG. 13 may be used so that the truncating facet forms a leading face for the PCD rock removing element such that a higher shearing component of force may be applied to the rock face;

FIGS. 15*a* to *e* show schematically some general means of attachment of free standing PCD bodies to housing bodies and provides an indication of the general shape of the functional support volumes which are appropriate for the means of attachment indicated;

FIG. 16*a* is a schematic diagram of particular embodiment of a 3-dimensional, right circular cylindrical free standing PCD body, where one physical volume of PCD material is a layer of substantial thickness which extends across one end of the PCD body;

FIG. 16*b* shows schematically the worn PCD rock removal body at end of life for this latter case;

FIG. 17 shows an embodiment of a right circular free standing PCD body having only two adjoining physical volumes of differing PCD material for use in rock shearing, where one physical volume of PCD material completely encompasses the functional working volume;

FIG. 18 shows an embodiment of a one hemi-spherical ended right circular free standing PCD body having only two adjoining physical volumes of differing PCD material for use in rock crushing, where one physical volume of PCD material completely encompasses the functional working volume;

FIG. 19 shows an embodiment of a free standing PCD body, intended for both rock shearing and rock crushing modes, having a single chisel ended right circular cylindrical shape, where the chisel shape is formed by two symmetrical angled truncations, and having only two adjoining physical volumes of differing PCD material, where one physical volume of PCD material completely encompasses the functional working volume;

FIG. 20 is a schematic representation of a cross section of the edge of the right circular cylindrical rock removal element angled to machine a rock face, showing four different types of chamfer;

FIG. 21 schematically shows a cross section of a wear scar formed by the progressive wearing of the functional working volume of a free standing PCD body, where a boundary between leached and unleached PCD material intersects the wear scar surface to form a shear lip;

FIG. 22 is a schematic diagram of an example embodiment based upon a right circular PCD body;

FIG. 23 is a schematic diagram of a quarter section of the embodiment of the example of FIG. 22 and presents the positions of the calculated stress maxima in the three cylindrical coordinate directions;

FIG. 24 is a schematic, cross-sectional representation of an embodiment, intended for use in a roller cone bit where predominantly a rock crushing action is required, where the overall shape of each body was a right circular cylinder, one end of which was formed by a hemisphere, and where various aspects of the invention are incorporated;

FIG. 25 is a schematic cross-sectional diagram, with two plan views, of an embodiment of a free standing body made solely of PCD material, intended for use in a housing body or drill bit, where the mode of rock removal is required to be a combination of crushing and shearing; and FIGS. 26 *a* and *b* are schematic, cross-sectional representations of two right circular cylindrical embodiments where the functional working volume consists of multiple physical volumes arranged as alternating layers of dissimilar PCD materials, for use as shear elements in drag bits.

This disclosure pertains to bodies or elements which are collectively, cooperatively and supportively, attached to or inserted into housing bodies and used for the removal of material such as rock, concrete and the like by mechanical action such as shearing and crushing. Housing bodies include the drill bits used in subterranean rock drilling such as those shown in FIGS. 3 and 5, namely, drag bits and roller cone bits, respectively. As used herein, the word "rock" will be considered to refer to both natural geological rock such as sandstone, limestone, granite, shale, coal and the like, and also synthetic or reconstituted rock-like materials such as concrete, brick, asphalt, and the like. These latter rock-like materials are broken down and removed in construction applications.

The bodies or elements of embodiments disclosed herein are free standing and made "solely and exclusively" of PCD materials. As used herein, the phrase "made solely of PCD materials" is to be understood to mean that there is an absence of volumes or regions or attached volumes which are made of non-PCD materials incorporated during manufacture of the PCD materials. Such non-PCD materials include hard metal substrates, ceramics and bulk metals and the like. The free standing PCD body may constitute any combination of different PCD materials which fall within the definition of PCD material as described above.

In the present applicants' patent applications U.S. Ser. No. 61/578,726 and U.S. Ser. No. 61/578,734 (references 1 and 2) it was disclosed that free standing PCD bodies of a multitude of 3-dimensional shapes and sizes limited only by the size and character of the high pressure high temperature apparatus used for their manufacture. The present disclosure exploits this capability and discloses embodiments of 3-dimensional shape and size as designed for and directed at rock removal elements. The contents of patent applications U.S. Ser. No. 61/578,726 and U.S. Ser. No. 61/578,734, references 1 and 2, respectively, are herein incorporated by reference for all they contain.

Each of the embodiments of the cutter elements disclosed herein for rock removal elements or bodies is considered to be configured in two functional regions or volumes. The first functional region or volume is the "working volume" of the element, which is the region or volume which comes into contact with the rock and causes the progressive removal of the rock by a combination of shearing and crushing and itself is progressively worn away during the lifetime of the rock removal element. The PCD material associated with the working volume, being composed of one or more physical region or volume, is designed in composition and structure for wear resistance. In the context of this disclosure, the word "functional" pertains to the specific role or behaviour expected by a part or region of the overall rock removal element or body. In contrast, the word "physical" pertains to specific and differentiable PCD materials occupying actual regions or partial volumes of the overall body. The second functional region or volume is the "support volume" of the element or body, which is extant to the life of the rock removal element, in that it remains and is the surviving portion of said PCD rock removal element or body after normal use. The functional support volume is a region or volume extending from the functional working volume and provides, by dint of its designed shape and dimensions, the means of attachment of the rock removal element to the housing body appropriate for the particular application. In addition, the PCD materials occupying the physical volumes which are associated with the functional support volume are designed in composition and structure to have appropriate properties for the provision of mechanical and thermal support to the functional working volume. The mechanical and thermal supports provided by the functional support volume to the functional working volume are key roles of the functional support volume.

A number of embodiments concern the relationship between two or more physical volumes and the two functional volumes but embodiments comprising one physical volume are also included.

To reiterate, from here on, when the terms "working volume" and "support volume" are used, it is always inherent that these are the functional volumes characterized in terms of their roles and behaviors in application. It may be re-iterated that the overall PCD body comprises one or more "physical volumes" which make up the functional working volume and functional support volume which are determined in use. When two or more physical volumes are employed, they differ with respect to the PCD materials which occupy these volumes and thus they differ in material properties.

The functional working volume is chosen to be distal to the overall volume and extends from a free surface or edge or boundary between free surfaces, which is part of the external boundary of the body. Distal in this context is defined to be a point or position away from the geometric centre or centroid of the overall free standing PCD body or element and also away from the position or area of attachment of the PCD body to the housing body. The distal extremity of the functional working volume is the position of first, initial point of contact with the rock to be removed.

The functional working volume extends to the functional support volume which is proximal to the overall PCD body volume, is opposite the distal working volume and has the purpose of providing means of attachment to the housing body. Proximal in this context is defined to be a point or position, including the point or position of attachment. The support volume encompasses the centroid or geometric centre of the overall free standing PCD body. The centroid or geometric centre is defined as the intersection of all planes that divide the 3-dimensional volume into two parts of equal moment. Where the 3-dimensional volume is made of material of uniform density, the centroid corresponds to the centre of gravity of the body.

The functional working volume extends from a distal free surface or boundary between adjacent free surfaces of the PCD body or element and comprises any combination of edges, vertices, convex curved surfaces or protrusions.

These form the distal extremity of the working volume and are the part or parts of the PCD body which are first made to bear on the rock surface.

Where the dominant rock removal mechanism is by shearing the rock, in order to provide a controlled chosen initial degree of sharpness, the preferred distal extremity will be an edge which is the boundary between two free surfaces. Such edges may be created by forming a chamfer or multiple chamfer arrangements at the distal extremity of the working volume. Such arrangements of multiple chamfers for cutting elements of earth boring tools are taught and claimed in patent applications WO 2008/102324 A1 and WO 2011/041693 A2, references 5 and 6, respectively, the contents of this reference are incorporated in the present disclosure for all they contain. Depending on the 3-dimensional geometry of the PCD body, such edges may be straight or curved.

Where the dominant rock removal mechanism is by crushing the rock, the preferred distal extremity will be a curved convex surface, for example a dome.

Depending upon the relative degree of chosen rock removal mechanism between shearing and crushing, the preferred distal extremity may be a rounded vertex, apex or protrusion, for example a rounded conical apex.

One of the functions of the support volume is to provide mechanical support to the working volume to engender strength to the working volume and to reduce applied stresses. An appropriate consideration of mechanical support may be derived from the principle of massive support as introduced in the context of high pressure apparatus design by P W Bridgman in 1935, reference 7. This principle exploits the 3-dimensional shape of a body whereby an applied force to the body is spread out over an increasing cross-sectional area so that the stress, which is nominally the force divided by the area of the section at right angles to the force, is reduced. In the context of the present disclosure, forces applied to the PCD rock removal body or element during application via the functional working volume are spread out to reduce stress by an increasing cross-sectional area in the working volume as the functional working volume extends into the functional support volume. This can be illustrated by considering FIG. 8 where a free standing PCD body of generalized shape, 801, is shown inserted into part of a housing body, 802. For subterranean rock drilling applications, the housing body, 802, may be the drill bit body itself like that of the drag bit, 301, of FIG. 3 or for the roller cone bit body, 501, in FIG. 5. The working volume, 803, is separated from the support volume, 804, by the nominal boundary shown by the dotted line, 805. The applied forces on the functional working volume, initially at the distal extremity of the functional working volume, 806, can very generally be described in terms of vertical force $F_v$, 807, and horizontal force $F_h$, 808, components as referred to the overall free standing rock removal element or body, 801. No matter what the dominant rock removal mechanism is, the two components of force are always present; however, their proportions may vary. The line a-c-d extends from the distal extremity of the functional working volume, 806, at a, to the geometric centre or centroid, c, of the whole body to a proximal extremity of the functional support volume at d. By virtue of the cross-sectional area of the functional working volume along the line a-c-d extending into the functional support volume, the resultant force of Fv and Fh is progressively distributed over an increase of cross-sectional area. In this way the applied stresses in the working volume are progressively reduced. Embodiments disclosed herein may have this increase in cross-sectional area of the functional working volume as it extends towards and into the functional support volume.

Figure 8:
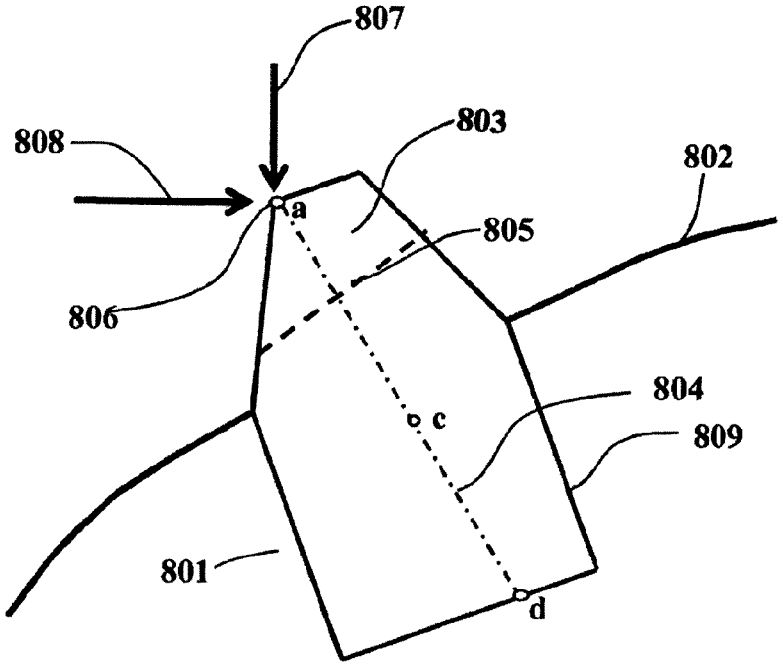
FIG. 8 illustrates the concept of massive support by example of a free standing PCD body of generalized shape shown inserted into part of a housing body.

A further feature of the principle of massive support is to organize the volume and aspect ratio of a body to withstand rotational moments and bending stresses. The consequences of the application of this aspect of the principle of massive support to the geometry of the general free standing PCD embodiments are that the functional support volume is greater in volume than the functional working volume and should necessarily contain the centroid of the overall PCD body and, in addition, a specified aspect ratio. FIG. 8 is illustrative in this regard as applied to a general exemplary free standing PCD body. The horizontal component of the applied force, 808, $F_h$, is applied to the distal extremity, that is the distal free surface, of the functional working volume and is displaced from the general area and points of attachment of the support volume as it is inserted in the housing body, 802. This results in a rotational moment applied to the overall free standing PCD body. To withstand this rotational moment, the support volume may be larger in volume than the working volume and the aspect ratio of the overall PCD body may be sufficient in magnitude to enable the degree of insertion of the PCD body into the housing body to be large enough in order to counteract the rotational moment. In this way a substantial volume of the housing body itself is brought into effect to counteract the rotational moment. In addition, when the vertical component of the applied force, 807, Fv, is considered, it may be seen that a bending stress is induced on the proximal extremity or face of the support volume. Again, to counteract this bending stress, the support volume may be large as compared to the functional working volume and an aspect ratio of the overall PCD body of sufficient magnitude is required for the proximal extremity or face of the functional support volume to be adequately remote from the functional working volume.

Figure 9:
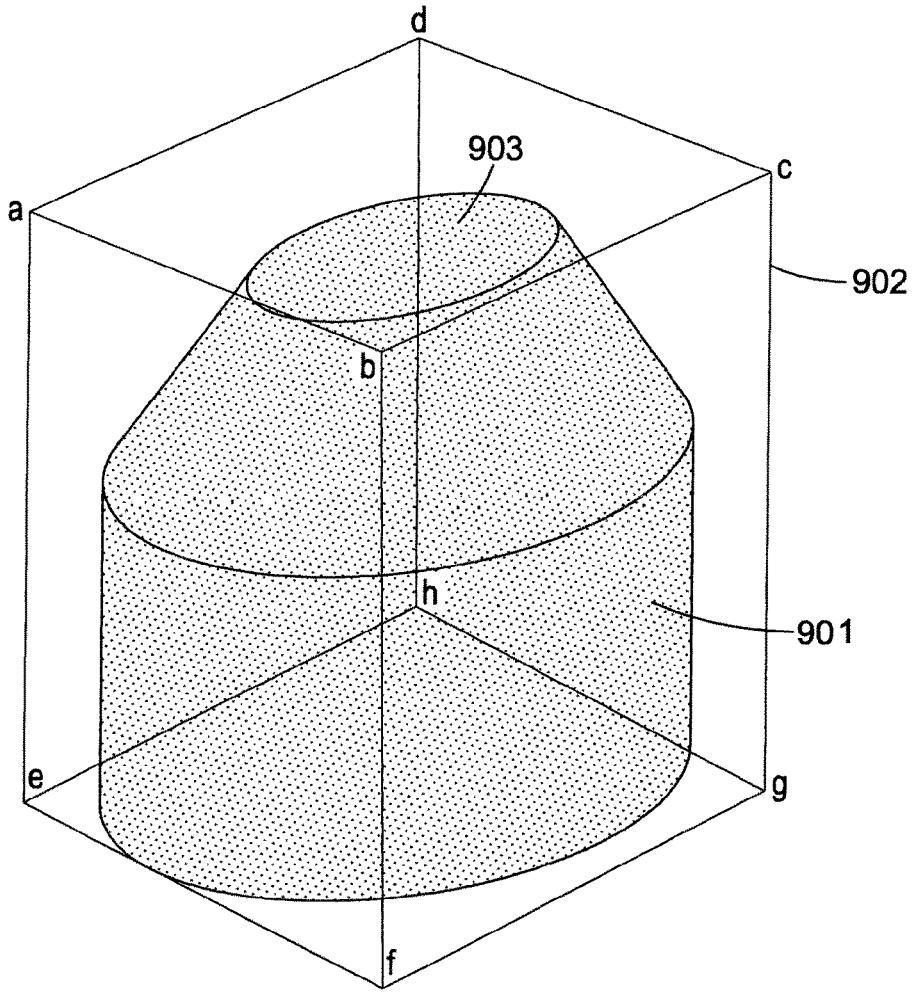
FIG. 9 is a 3-dimensional representation of the same generalized exemplary free standing PCD body of FIG. 8 with a circumscribing rectangular parallelepiped used to demonstrate its use in calculating the aspect ratio of the PCD body.

A convenient and accurate way to specify the desired aspect ratio of the overall free standing PCD body is to consider a dimensional edge ratio of a rectangular parallelepiped which circumscribes and completely encloses the 3-dimensional PCD body shape. FIG. 9 is a 3-dimensional representation of the same generalized exemplary free standing PCD body, 901, of FIG. 8 with a circumscribing rectangular parallelepiped, 902, delineated by abcdefg. Note that the functional working volume, 903, extends from one of the smallest rectangular faces of the rectangular parallelepiped, abcd.

With reference to FIG. 9, the required aspect ratio of the overall PCD body may be expressed specifically as the ratio of the length of the longest edge, ae, of the circumscribing rectangular parallelepiped, 902, of the overall PCD body, 901, to the largest width, ad, of the smallest rectangular face, abcd, from which the functional working volume, 903, extends, being greater than or equal to 1.0.

In patent applications U.S. Ser. No. 61/578,726 and U.S. Ser. No. 61/578,734, references 1 and 2, respectively, which are herein incorporated by reference, it was disclosed that the practical dimensions of 3-dimensional shaped free standing PCD bodies are limited by the dimensions and design characteristics of the high pressure high temperature apparatus used to manufacture them. It was established by reference to the size of various high pressure high temperature systems known in the art that the maximum dimension of any free standing PCD body can be up to 150 mm and that a preferred and appropriate system design for such purposes was the so-called belt type apparatus. A convenient way of relating this maximum dimension to any of the PCD free standing bodies of the present invention is to specify that the longest edge of the circumscribing rectangular parallelepiped of the overall PCD body, ae, in FIG. 9 can thus be up to 150 mm.

In summary, the derived general geometrical aspects of some embodiments of cutter elements disclosed herein are that the free standing PCD body comprises a functional working volume distal to the overall PCD body, a functional support volume proximal to the overall PCD body, the functional working volume has an increase in cross sectional area along the line extending from the distal extremity of the functional working volume, into the functional support volume, through the centroid to a proximal extremity of the functional support volume, the functional support volume is larger in magnitude than the functional working volume and always contains the centroid of the overall PCD body and that the aspect ratio is sufficiently large as defined above.

As explained above, the overall free standing PCD rock removal body or element is made up of two functional volumes with different and distinct primary functions and purposes. This implies that the materials associated with the two functional volumes should preferably be different in composition and structure and, hence, properties. The functional working volume by definition is the portion of the PCD body which progressively bears upon the rock surface, causes the rock to fracture and itself is progressively worn away. A dominant desired property for the material associated with the functional working volume is, therefore, a high wear resistance. This material, therefore, is best chosen to be made of diamond and metal network compositional ratios, metal element compositions, and diamond grain size distributions known to provide high wear resistance behaviors for rock removal. Conversely, the dominant desired properties for the material associated with the functional support volume are rigidity for mechanical support and high thermal conductivity for efficient heat removal. Wear resistance is of secondary consideration. The material best chosen for the functional support volume is, therefore, made of diamond and metal network compositional ratios, metal element compositions, and diamond grain size distributions known to provide high rigidity and thermal conductivity. The PCD material associated with the functional working volume and adjacent to the distal surface or free surfaces of the functional working volume are preferentially chosen to be different in diamond grain size distribution to that of the PCD material associated with the functional support volume and adjacent to the proximal surface or surfaces of the functional support volume. Some embodiments have a difference in PCD material composition associated with the functional working volume as compared to the functional support volume, so that the properties of the materials associated with each of the functional volumes are best suited to their different purposes in use during each application.

To summarize, the free standing PCD body may be made of two or more physical volumes within the boundary of the PCD body, where the PCD materials for the whole body are invariant in terms of the diamond and metal network compositional ratio and the metal element composition ratio such that each adjacent physical volume differs in diamond grain size distribution. The differing PCD materials may or may not be directly associated and adjacent to the distal free surface or free surfaces of the working volume and the proximal surface or surfaces of the support volume. Some embodiments have this character of being made of two or more physical volumes.

Other embodiments may be made solely of one physical volume of PCD material of one composition.

A subset of embodiments are where the overall PCD body has two or more physical volumes and the whole peripheral region or "skin" of the overall PCD body differs in composition and/or structure from the PCD material or materials in the central region or regions. However in the case of this group of embodiments, the PCD material adjacent to the distal free surface or surfaces of the functional working volume and the proximal surface or surfaces of the functional support volume is the same and does not differ. Such free standing PCD bodies have a continuous skin of chosen PCD material adjacent to the entire free surface of the overall PCD body, which differs in diamond and metal network compositional ratio, metal elemental composition and diamond grain size distribution to the material or materials of the internal physical volume or volumes. The latter volume or volumes do not have a free surface before use. In use, the functional working volume is progressively worn away and the resultant wear surface may expose the internal physical volumes of material.

An important subset of embodiments of the latter group are where the overall PCD body has been subjected to means of partial or complete removal of metal to a chosen limited depth from its free surface and, thereby, creating a "skin" of modified and therefore different PCD material. Means of creating such a metal depleted "skin" are well known in the art and include acid bath treatments of the PCD bodies.

Generally, in applications, rock is removed and displaced by rock removal elements or bodies made to dynamically bear upon the rock, causing the rock to fracture by a combination of shearing and crushing actions or modes. The rock fracture can be considered in terms of a "continuum" of the relative degree of crushing to shearing. This conceptual model is illustrated in FIG. 10*a* to *f*, which schematically indicates how rock removal elements or bodies can fracture rock with respect to the relative vertical (or normal) and lateral (or tangential) forces applied to the rock removal elements or bodies. The rock removal elements or bodies are inserted cooperatively (side by side) into the wings or blades of a drag bit as in FIG. 3, or alternatively the cones of a roller cone bit as in FIG. 5. The rock removal elements in the separate blades or cones are geometrically arranged in such a manner that they supportively overlap during one rotation of the drill bit housing body so that the whole rock surface area is covered and swept.

FIGS. 10*a* to *f* schematically depict the range of rock removal modes from pure shear at FIG. 10*a* to pure crushing at FIG. 10*f*. FIG. 10*a* shows a hypothetical rock removal element or cutter, 1001, which fractures the rock by pure shear indicated by the single lateral arrow, which is a representation of the force magnitude. The antithesis of this is depicted in FIG. 10*f* which shows the action of an indentor which fractures the rock by a vertically directed crushing action alone. Both these means of rock crushing are pure and a practical drill bit cannot exploit such pure modes of rock removal in these ways as both vertical and tangential forces must be present. In practice, any rock removal element will fracture the rock with a combination of shearing and crushing as drill bits must employ a rotary action.

In drag bit designs, the rock removal elements or bodies are dragged in a circular manner in contact with the rock base with a limited downward force and a dominant tangential force as depicted by the arrows in FIG. 10*b*. In this mode of rock removal, the rock is fractured predominantly by shear. FIG. 10*b* shows one edge of a right cylindrical PCD rock removal element or body, 1002, continuously shearing the rock. Such PCD rock removal bodies or elements may be cooperatively set in blade like structures of the drill bit body, as in FIG. 3, so that they are appropriately angled to the rock face, and are supportively off-set behind one another so that the rock face being sheared is completely covered by each rotation of the drill bit.

FIG. 10*e* illustrates rock removal by predominantly crushing where the vertical loading is significantly greater than the lateral tangential loading. This rock removal mode is historically exploited in so-called roller cone bit designs shown in FIG. 5. In such drill bit designs, rounded, dome-ended or chisel-ended rock crushing elements are set in freely rotating conical rollers arranged at the face of the drill bit. In FIG. 10*e* a hemispherical dome-ended right cylindrical rock removal element, 1005, is exemplified. When the drill bit is rotated the conical rollers continuously roll around the rock face, bringing each dome-ended rock removal element to bear in turn on the rock face thereby intermittently bearing upon and crushing the rock face. FIG. 10*e* schematically indicates by means of the vertical and horizontal arrows, respectively, the loading magnitudes caused to occur for such rock removing elements.

In principle it is possible to cause rock fracture by an intermediate situation between FIGS. 10*b* and 10*e* by varying the angle of attack and dynamic of how any rock removal element is brought to bear on the rock, together with choice of appropriate shape. The appropriate shape choice involves the distal extremity of the functional working volume being chosen to be an appropriate combination of edges, vertices, apices, curved surfaces or protrusions which is caused to bear on the rock. In this way, the relative components of applied loading can be varied and the rock may be removed by a chosen combination of shearing and crushing. This is illustrated by FIGS. 10*c* and 10*d* where the mode of rock removal changes from predominant shearing to predominant crushing. In FIG. 10*d*, the exemplary rock removal element shown, 1004, has a chisel shaped functional working volume, the distal extremity of which is a rounded vertex formed by the intersection of four flat surfaces on a right cylindrical shaped body. Here the crushing action still outweighs the shearing action which, nevertheless, is of a significant magnitude. In FIG. 10*c*, the exemplary rock removing element shown, 1003, has a conical functional working volume modified by an elliptical flat leading edge surface which provides an elliptical curved edge distal extremity of the functional working volume. Here the crushing and shearing actions are similar in magnitude, again as indication by the arrows.

The efficiency of the rock removal body or element for any particular combination of crushing and shearing is dependent upon the shape of the part of the rock removal body or element made to bear on the rock, i.e., the distal extremity of the functional working volume of the rock removal body. The distal extremity of the functional working volume in particular may be chosen in this regard.

The above conceptual model for rock removal which indicates a continuum between shearing and crushing modes of rock removal is a novel approach which has been developed for facilitating the choices of preferred and optimized 3-dimensional shapes for the functional working volume, and its distal extremity, of the free standing PCD rock removal elements or bodies of the present disclosure.

The teachings of patent applications U.S. Ser. No. 61/578,726 and U.S. Ser. No. 61/578,734, references 1 and 2, respectively, in regard to free standing PCD bodies of wide ranging regular and irregular 3-dimensional shapes offer the opportunity to choose and optimize the shape of the functional working volume to engender efficient rock removal and choosing and varying any relative degree of crushing and shearing of the rock. This is done by choosing different edges and corners of the vast range of 3-D solid shapes possible, and the angle of the rock removal body used to bear on the rock. Each shape requires an appropriate choice of reference face of the rock removal body by which the body is angled with respect to the rock face. In the case where the rock removal body is a right circular cylinder, an appropriate face is the leading flat circular surface, the distal extremity of the functional working volume being one part of the circumferential edge of that face.

In FIGS. 10*b,c* and *d* the shearing component of the rock crushing action progressively changes from being predominant at FIG. 10*b* to secondary at FIG. 10*d* but is always significant in that a directional shearing or plowing action is involved. Consequently, the functional working volume is conveniently organized to have a mirror plane of symmetry determined by the plane of action of the applied vertical and tangential/horizontal forces at any given moment.

To exemplify this, FIG. 11*a*, is a schematic 3-dimensional drawing of a right cylindrical free standing PCD rock removal element or body, 1101, bearing on rock, 1102, where the distal extremity of the working volume is part of the circumferential edge of one part of the cylinder, 1103. This overall right cylindrical shape is typical of rock removing elements or bodies employed in drag bits for subterranean rock drilling as in FIG. 3.

The applied forces determine a mirror plane from the point of contact with the rock. In this case, the distal extremity of the working volume is part of a curved edge. Therefore, a general group of embodiments may be characterized by free standing PCD bodies where the working volume has a mirror plane of symmetry extending from the distal extremity of the working volume.

Common features of some embodiments are suitable and preferred for modes of rock removal that are predominantly shearing, is that the distal extremity of the working volume before use, that is the part which initially bears on the rock at the commencement of use, is made up of an edge or edges. An edge in this context is defined as a boundary between adjacent free surfaces. Such an edge or edges may be curved or straight or any combination of such. The distal extremity may also be one or more vertex where more than one edge joins to another. The functional working volume of the PCD body has a mirror plane of symmetry extending from these edge or vertex distal extremities. At any given instant when the PCD rock removal elements are applied to a rock surface, the mirror plane of symmetry extending from the distal extremity of the functional working volume corresponds to the plane determined by the vertical and tangential components of the applied force. Examples of such mirror planes extending from distal extremities of the functional working volumes are illustrated in FIGS. 11*a, b* and *c*, where the distal extremities are a curved edge, a straight edge and a vertex, respectively. The mirror plane of symmetry may or may not extend throughout the full geometry of the overall PCD body, depending upon the shape of the functional support volume chosen in regard to specific means of attachment to housing bodies, such as drill bit bodies.

An embodiment of a free standing PCD body for predominantly shearing rock removal is a right circular cylinder, 1101, where the distal extremity, 1103, of the functional working volume is a part of one circumferential edge, and is thus a curved edge, FIG. 11*a*. Embodiments where the overall shape is based on a right cylinder may also be modified by flat surfaces along the flank of the free standing PCD body which can provide straight edge components to the distal extremity of the functional working volume. FIG.

11*b*, is an embodiment which shows one flat surface along the flank or barrel surface of the cylinder, 1104, providing one straight edge, 1105, as the distal extremity of the functional working volume. More than one straight edge can be employed by more than one flat surface along the flank as in FIG. 11*c*, 1106 and 1107. Here the distal extremity of the functional working volume is now a vertex, 1108.

All of the embodiments in FIG. 11, have a mirror plane of symmetry, 1109, extending from the distal extremity of the working volume, corresponding to the plane formed by the vertical and tangential applied forces, 1110 and 1111, respectively.

When the dominant mode of rock removal is crushing as in FIG. 10*e*, a typical overall shape for the rock removing elements or bodies is a dome ended right cylinder as illustrated. An embodiment for this case would be a PCD body, 1201, where the working volume is hemi-spherical, 1202, as in FIG. 12*a*, with the distal extremity being a convex curved surface, 1203, which clearly exhibits the concept of massive support whereby the immediate stress at the point of contact with the rock is spread out into the support volume due to the increase of cross-sectional area. Alternatively, as in FIG. 12*b*, the shape of the working volume can be cone shaped, 1204, with a rounded apex or a rounded truncation as the distal extremity, 1205.

Both of these embodiments exhibit an n-fold axis of rotational symmetry through the distal extremities of the functional working volumes, 1206. More generally, any shape with rotational symmetry about an axis extending from the distal extremity of the working volume to the proximal free surface of the support volume, wherein the cross-sectional area significantly increases in the direction of the axis is desired, so that massive support can be engendered to the working volume. Even more generally the rotational symmetry can be n-fold as in the case of the dome ended right circular cylinder, FIG. 12*a*. An alternative description for this latter situation is that the PCD body has an infinite number of mirror symmetry planes extending from the distal extremity of the working volume.

These general embodiments may be modified by the addition of flat surfaces or facets introduced at the general 3-dimensional curved surface of the functional working volume. By so doing, the boundaries between such flat surfaces or facets being apices, curved edges or straight edges can be formed and exploited as the distal extremity of the working volume. These shapes are generally referred to as "chisels" in this context. This allows increasing degrees of shearing action in rock removal by choice of the rake angle in relation to the rock face as illustrated in FIGS. 10*d* and 10*c*. PCD rock removal bodies or elements of these very general chisel shapes comprise some embodiments of the present disclosure. These embodiments may exhibit rotational symmetry about the distal extremity of the working volume increasing from a 2-fold rotational symmetry (a single mirror plane) as indicated in FIG. 10*c* up to the n-fold rotational symmetry of FIG. 10*e*. For example, FIG. 10*d* illustrates a PCD body with a conical surface modified by 4 adjacent flat surfaces or facets and shows a 4-fold rotational symmetry. Alternatively, one or more flat surface or facet may be introduced at the general curved free surfaces of the functional working volume such that the flat surfaces are isolated and do not have a common boundary. In such cases, the distal extremity of the working volume will be a curved edge or in the very specific case of a single flat surface extending to the tip of a conical working volume will be an apex.

FIGS. 13*a,b* and *c* illustrate a further example where one flat surface, 1301, 1302, 1303, truncates a conical working volume, 1304, where the distal extremity of the working volume may be chosen to be a position on the curved edge which bounds the flat truncation facet, 1301, 1302, 1303, and the curved surface of the cone, 1305. Depending on the angle of the truncating facet to the axis of the cone, such a curved edge may be circular, 1306, elliptical, 1307, or parabolic, 1308, as illustrated in FIGS. 13 *a, b* and *c*, respectively. Such embodiments may be used so that the truncating facet forms a leading face for the PCD rock removing element or body as shown by 1401 in FIGS. 14*a* and *b*. In this way, a higher shearing component of force may be applied to the rock face.

Some further embodiments may include distal extremities of the working volume being apices or straight edges chosen from the boundaries between flat surfaces only. Examples of such an embodiment would be where one end of a PCD right cylindrical shaped body is modified at one end by multiple flat surfaces to form general chisel shaped working volumes. The support volume shape of such embodiments is formed by the unmodified part of the right cylinder, the cross section of which may be a circle or an ellipse.

Figure 15A:
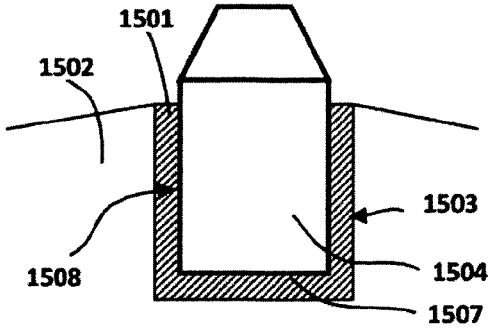

Support volumes which have a right circular cylindrical shape comprise some embodiments of the present disclosure with any of the different types of functional working volume shapes described and disclosed above. An advantage of such embodiments is ease of attachment to housing bodies or drill bit bodies where the dominant historical custom and practice of brazing of such bodies into cylindrical placement holes or slots can be exploited. FIG. 15 shows and discloses some general means of attachment to housing bodies and provides an indication of the general shape of the functional support volumes which are appropriate for the means of attachment indicated. FIG. 15*a* shows a free standing PCD rock removal element, where the functional support volume, 1504, is a right circular cylinder, which is almost completely enclosed by and inserted into a housing body, 1502. The dimensions of the support volume relative to those of the hole into which it is to be inserted may be chosen so that elastic interference at the interface 1508 can provide secure attachment after shrink fitting. Alternatively, the surface of the support volume may be coated in metallic films suitable for brazing procedures. Support volume aspect ratios where the length is greater than the diameter are advantageous so that when the bulk of the support volume is enclosed and inserted in the housing body, the inherent rotational moment in use is counteracted.

Right cylindrical shapes with elliptical cross sections may be used. However, for ease of manufacture and attachment, right circular cylindrical shapes with circular cross sections may be preferred.

Further embodiments may be derived from those with cylindrical shaped support volumes by introducing one or more flat surfaces or facets along the barrel of the cylinder for indexing and location purposes in the housing or bit body.

Embodiments where the support volume is bounded solely by flat surfaces along its flank or long axis may also be used where the cross section of such support volumes is polygonal with three or more sides forming a column.

These embodiments with cylindrical or columnar support volume shapes are appropriate for attachment to housing bodies or drill bit bodies using brazing or elastic interference attachments by push fitting.

A common aspect of these embodiments is that the support volume shape is straight sided with a constant perpendicular cross sectional area. The most common historical means of attachment of rock removing elements or bodies to housing bodies or drill bits is brazing. A clear disadvantage of this latter approach is that the elevated temperatures necessary for the brazing may thermally damage a PCD material. Mechanical means of attachment do not suffer from this as increased temperatures are not involved.

Figure 15B:
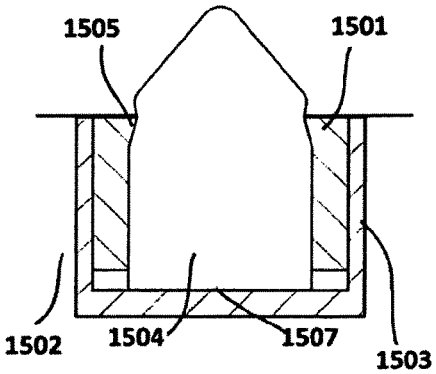
Figure 15C:
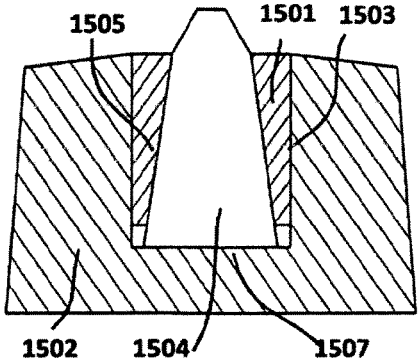
Figure 15D:
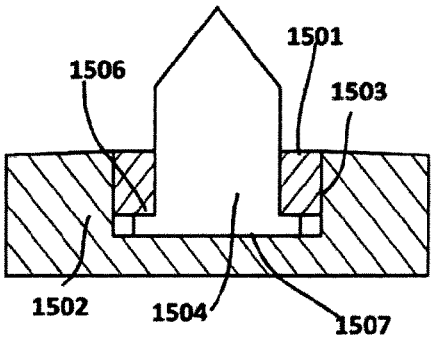

Mechanical means of attachment may employ arrangements such as those shown in FIGS. 15*b* to 15*e* which use an elastic collar, 1501, mating with the housing body, 1502, via a thread, 1503, or other mechanical locking means, bears down upon an expanded cross sectional area in the functional support volume, 1504. This is illustrated in FIGS. 15*b, c, d* and *e* where an externally threaded collar, 1501, locates on its internal surface onto conical mating surfaces, 1505, of the functional support volume, as in FIGS. 15*b, c* and *e*. Alternatively the expanded cross sectional area in the functional support volume may be provided by flange arrangements as illustrated in FIG. 15*d*, where a collar, 1501, locates on a flange, 1506. A common feature of all such arrangements is that the support volume shape employs an increase in cross sectional surface area parallel to a flat base or proximal surface, 1507, of the support volume. More generally, the functional support volume increases in cross sectional area along the general direction from the distal functional working volume to the proximal surface of the functional support volume.

Figure 15E:
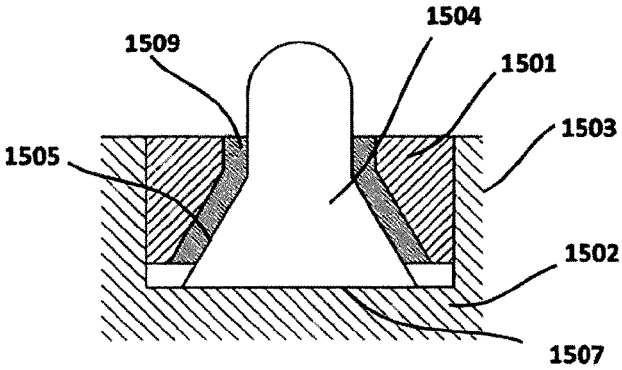

EP0573135, reference 8, discloses that a deformable locking insert may be used to improve the mechanical attachment of appropriately shaped abrasive tool bodies to housing bodies. The teachings of this patent are incorporated into the present disclosure by reference. This is illustrated in FIG. 15*e* where the threaded insert, 1501, bears down on a deformable locking insert, 1509, which in turn bears upon a conical surface, 1505, of the functional support volume, 1504 of the free standing PCD body. The deformable insert, 1509, may be made of soft, ductile metals such as annealed copper and the like and/or high density polymeric materials such as elastomers, rubbers or polymers and the like.

Yet another means of mechanical attachment to housing bodies may be to employ threaded functional support volumes, of the free standing PCD body itself, which then mate with a thread in the housing body.

A number of embodiments of this disclosure exploit only two physical volumes of PCD material differing in composition and/or structure. The PCD material of one physical volume may at least include the region adjacent to the distal surface or free surfaces of the functional working volume with a different PCD material of the other physical volume at least including the region adjacent to the proximal surface or surfaces of the functional support volume. The boundary between the two physical volumes of differing PCD materials may not coincide with the notional boundary between the functional volumes, namely, the working and support volumes. This latter boundary may only be finally determined by the extent of the wear flat or wear scar generated at end of life of the PCD body in a rock removal application.

To illustrate the relationship between the two physical volumes of different PCD materials and the functional working and functional support volumes, FIG. 16 presents schematic cross-sections of some selected non-comprehensive embodiments where the common feature is that the overall 3-dimensional geometry of the free standing PCD body is a right circular cylinder, where the distal extremity, 1601, of the functional working volume, 1602, is one part of the circumferential edge of one end of the cylinder.

FIG. 16*a* is a particular embodiment where one physical volume of PCD material (PCD1) is a layer of substantial thickness, 1603, which extends across one end of the overall right circular PCD body and the second volume of PCD material (PCD2) is larger and occupies the remaining part, 1604, of the overall PCD body. The physical volume of material PCD1, 1603, is associated with the functional working volume in that the material PCD1 occupies the region adjacent to the distal surface or free surfaces of the functional working volume, 1602, the distal extremity of which is the part of the circumferential edge, 1601. This distal extremity of the working volume is the first part of the PCD body to make contact with the rock face, 1605. During rock removal, the working volume of the PCD body is progressively worn and forms a wear flat or wear scar, shown as the dotted line, 1606, nominally parallel to the rock face. In the particular case of 1606, the wear flat may denote the chosen end of life of the PCD rock removal body and thus, by definition, will indicate the boundary between the functional working volume and support volume. In the particular case of FIG. 16*a*, this boundary is schematically completely within the physical volume, 1603, which consists of material PCD1. Thus in this case the one physical volume, 1603, encompasses the functional working volume, 1602, and the boundary between the two physical volumes does not extend into the functional working volume. Alternatively, as in the case of FIG. 16*b*, the life of the PCD rock removing body may be extended such that the wear flat or wear scar, 1607, may be reached. In this case the wear flat now extends into the physical volume 1604 which consists of material PCD2. In this case, 1607 now indicates by definition the boundary between the functional working volume and support volume. During the latter part of the life of this particular case, the working volume exploits both the PCD materials of physical volume 1603, PCD1, and physical volume 1604, PCD2. In general, the extent of the functional working volume of the PCD body is determined in use and becomes finally evident at the point of end-of-life of the PCD rock removal element or body. FIG. 16*b* shows schematically the worn PCD rock removal body at end of life for this latter case. In this latter case, the boundary between the two physical volumes, 1603 and 1604, extends into the functional working volume.

As already indicated in the above text, the PCD material which is dominant in regard to the desired behavior of the working volume should be chosen and optimized in regard to wear resistance in the context of rock removal mechanisms. In contrast, the material dominating the functional support volume should be chosen to be high in both stiffness and thermal conductivity. The most important compositional aspect of PCD materials which determines properties such as wear resistance, stiffness and thermal conductivity is the diamond grain size distribution. Accordingly, in some embodiments the diamond grain size distribution differs for the material which dominates each of the two functional volumes. Some of the embodiments are free standing PCD bodies comprising two or more physical volumes of PCD material where at least one of which differs in diamond grain size distribution from any or all of the others.

A general observation in the context of PCD in rock removal applications is that the wear resistance tends to increase as the diamond average grain size decreases. Since, as already pointed out, the working volume is progressively worn away during rock removal applications and the support volume is extant, a set of embodiments are such that the PCD material of the functional working volume is made of a finer average grain size than that of the functional support volume.

The functional support volume by definition is extant, and survives application and provides both mechanical and thermal support to the working volume. For good mechanical support over and above that provided by the shape and geometry of the body, the material which should dominate the support volume should be designed to be rigid with high stiffness and modulus of elasticity. Stiffness and modulus of elasticity increase as the diamond grain size increases. For good thermal support, the material which dominates the support volume may be designed to be of high thermal conductivity. Due to the thermal scattering behavior of grain boundaries limiting the heat conduction the thermal conductivity of a PCD material increases as the diamond grain size increases as this leads to lowering of the area per unit volume of grain boundaries. Therefore, the desired properties for the function of the support volume is engendered by a coarse diamond grain size distribution, whereas the desired high wear resistance of the working volume is engendered by a fine diamond grain size distribution.

Some embodiments of free standing PCD bodies may be designed to have two or more physical volumes of differing PCD materials, such that the PCD material adjacent to the distal surface or the free surfaces of the working volume is smaller in average grain size to the PCD material adjacent to the proximal surface or surfaces of the support volume.

It is well known in the art that PCD materials with average diamond grain sizes less than ten (10) micro meters have superior wear properties in the context of rock removal, i.e., a lower wear rate, than coarser PCD materials. Embodiments where the PCD materials which dominate the functional working volume and are adjacent to the distal extremity of the functional working volume have an average diamond grain size less than ten (10) micro meters may therefore be selected.

It was disclosed by Adia and Davies in patent application numbers U.S. Ser. No. 61/578,726 and U.S. Ser. No. 61/578,734, references 1 and 2, respectively, that using the disclosed method key material characteristics or degrees of freedom such as diamond grain size and distribution, diamond and metal network compositional ratio and metal elemental composition could be chosen and specified independently of one another. This is in contrast to the dominant, conventional prior art where these degrees of freedom are significantly dependent on one another. For example, in the predominant, conventional prior art, choice of grain size distribution largely restricts the scope of metal content possible, where also the metal content invariably increases as the average grain size decreases. The material degree of freedom independence of applications U.S. Ser. No. 61/578,726 and U.S. Ser. No. 61/578,734, references 1 and 2, respectively, are exploited in their pertinence to free standing PCD bodies for rock removal purposes in the present disclosure. This allows the diamond grain size and size distribution to be changed independently of the metal content and the metal elemental composition. As explained above, where two physical volumes are used, it may be desirable to have differing diamond grain sizes which dominate the two functional volumes to suit their different functions. This may now be done while the metal content and metal elemental composition is chosen to be invariant and constant throughout the overall PCD body. Such embodiments have the desired effect of the absence of macroscopic residual stress above a particular scale dependent upon the coarsest diamond grain size present in the overall PCD body. Such absence of residual stress at and above a macroscopic scale was taught and disclosed by Adia and Davies in patent applications U.S. Ser. No. 61/578,726 and U.S. Ser. No. 61/578,734, references 1 and 2, respectively. It is taught that where adjacent physical volumes are made from different PCD materials such that there are differences in thermal expansion coefficients, a physical volume spanning residual stress distribution arises due to differential contraction of the adjacent physical volumes on return to room temperature at the end of the high temperature manufacturing process. The differences in thermal expansion coefficient are brought about where the adjacent physical volumes differ in diamond and metal network compositional ratio and/or metal elemental composition. The physical volume spanning the macroscopic scale was defined to be at a scale greater than ten times the average grain size, where the coarsest component of grain size is no greater than three times the average grain size.

Where the adjacent physical volumes are invariant in diamond and metal network compositional ratio and metal elemental composition no differences in coefficient of thermal expansion will be present above this scale and the free standing PCD body will be macroscopically residual stress free above this scale. Adjacent physical volumes may differ in diamond grain size distribution and still remain macroscopically residual stress free. The desirability of such embodiments resides in absence of PCD body spanning residual stress distributions which, when present, guide and promote macroscopic crack propagation, which, in turn, may lead to fracture events such as chipping and spalling which compromise the life and performance of the rock removal body. As a consequence of the free standing PCD bodies having no or low macroscopic residual stress, in actual applications it would be expected that normal wear behaviour rather than fracture of the PCD bodies would be observed and determine the end of life of the PCD body. These embodiments therefore are expected to have improved performance and useful life.

There are several means of determining the presence or absence of macroscopic residual stress in free standing PCD bodies known in the art including x-ray diffraction. A convenient method to determine the absence of macroscopic residual stress involves the secure attachment of a strain gage rosette to any convenient flat surface of the PCD body followed by removal of a significant proportion of the PCD body. Where macroscopic residual stresses are absent, the strain related signals from the strain gage will not change. Conversely, if significant macroscopic residual stresses are present, the strain related signals from the strain gage will change significantly.

Some embodiments comprising free standing PCD bodies where the metal is constant and invariant throughout the overall PCD body at a scale above 0.1 mm (100 micro meters) are described herein where the coarsest component of grain size is 30 micro meters.

It is well known in the art that the properties and related behavior in application of PCD materials are highly dependent upon the diamond and metal content. In particular, the wear resistance, stiffness and thermal conductivity are all generally improved when the diamond content is increased (i.e., when the metal content is reduced). Improvements in these properties and behaviors are desired both for the functional working volume and the functional support volume of free standing bodies intended for rock removal applications. As explained above the teachings of Adia and Davies in patent application numbers U.S. Ser. No. 61/578,726 and U.S. Ser. No. 61/578,734, references 1 and 2, respectively, provide for PCD materials to be made with independent choice of diamond grain size distribution, diamond and metal network compositional ratio and metal elemental composition. The diamond and metal network compositional ratio can thus be selected to be high, i.e., the metal content low, regardless of chosen diamond grain size and metal type or alloy. Further, it is taught, when conventional fine grain PCD of about 1 micron average grain size is made by infiltration of metal from a hard metal substrate, as in the prior art, the metal content is restricted to about 12 to 14 volume percent. In contrast, the methods disclosed herein provide for the metal content to be chosen independently to the metal type and be anywhere in the range from about 1 to 20 percent. Similarly, where a multimodal grain size is chosen and the average grain size is about ten micro meters with the maximum grain size about 30 micro meters, again the metal content may be chosen anywhere in the range from about 1 to about 20 percent. The metal content for such a conventional PCD material being restricted to around and close to 9 volume percent no longer applies.

Metal contents lower than that defined by the formula $y=-0.25x+10$ where y is the metal content in volume percent and x is the average grain size of the PCD material in micro meters, may be exploited using the methods described in U.S. Ser. No. 61/578,726 and U.S. Ser. No. 61/578,734, references 1 and 2, respectively. The embodiments of the present disclosure involve one or more physical volumes occupied by pre-selected PCD materials of chosen average diamond grain size. The average diamond grain size in the physical volumes associated with and dominating both of the functional working and support volumes may be deliberately chosen to engender desired behavior in application for these functional volumes. A free standing PCD body where the PCD material in any physical volume has a metal content which is independently pre-selected to be lower than a value y volume percent, where $y=-0.25x+10$, x being the average grain size of the PCD material in micro meter units is a feature of some embodiments.

Figure 7:
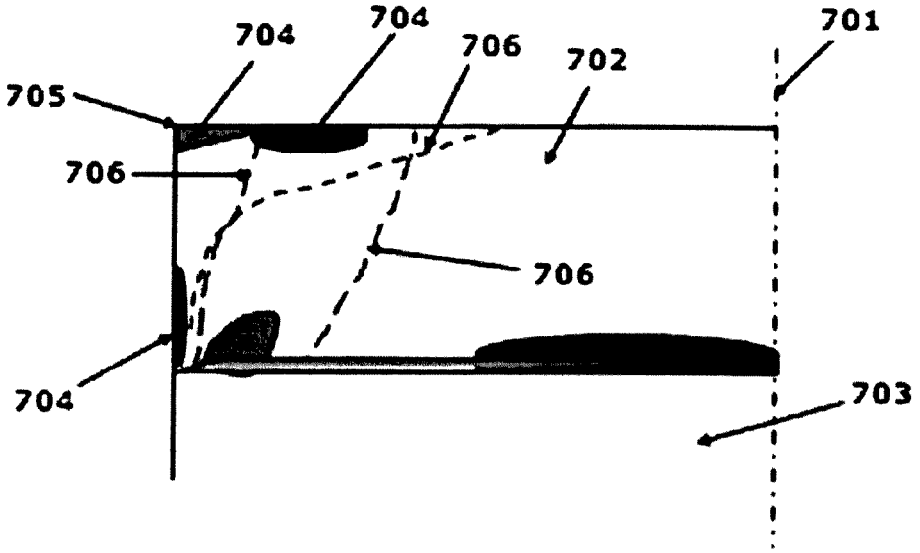
FIG. 7 is a schematic diagram of critical macro residual tensile stress zones in a conventional carbide supported rock removal shear element.

The custom and practice of the conventional prior art concerning layers of PCD material on hard metal substrates are such that the PCD layer thicknesses are restricted practically to about 2.5 mm. Since steep and significant gradients in the residual stress distributions occur close to and in relation to the physical boundaries between the dissimilar materials and the typical functional working volume dimensions are similar to the thickness dimensions, the working volume and adjacent regions necessarily experience high residual stress gradients invariably involving tensile stress maxima. FIG. 7 illustrates schematically the general nature of the residual stress distributions for most conventional prior art, namely for a PCD layer, 702, at one side of an overall right cylindrical body. In FIG. 7, which represents a part cross section of a conventional right cylindrical PCD rock removing element, 701 is the centre line of the right cylinder, 702 the PCD layer, 703 the hard metal substrate and 705 the distal extremity of the functional working volume, i.e. a part of the circumferential edge of the PCD layer, 702. In this diagram, the tensile residual stress maxima in cylindrical coordinates are indicated by 704. It may be noted that tensile maxima in the hoop, radial and axial directions all are at the free surface of the PCD layer at or close to the distal extremity of the functional working volume, 705, namely, one part of the circumferential edge of the right cylindrical overall PCD body. Also indicated is the boundary for each of the coordinate directions where the residual stress directions move from tension to compression, 706. It should be noted that all three of these boundaries are in close proximity to the distal extremity of the functional working volume, 705, illustrating that the residual stress gradients are high close to this position.

In some embodiments, the undesirable macroscopic residual stresses described above for the prior art where PCD material layers are attached and bonded in PCD material manufacture are absent by virtue of the metal invariance across the scale of the free standing PCD body. The absence of macroscopic residual stress is desirable in that it lowers the probability of macroscopic crack propagation and associated chipping and spalling problems when such cracks reach the free surfaces of the PCD body.

When chipping and spalling are significantly lowered, insignificant or absent, functional working volume is progressively removed by normal wear behaviour. In this situation, the increasing wear scar area can reach a large magnitude such that the required weight on bit generated by the drill rig becomes so large that the efficiency of the drill rig can become compromised.

End of life of the rock removing elements may thus be characterized by such maximum area magnitudes of the wear scar. Using this custom and practice, the typical maximum volume for the functional working volume can be estimated from the typically observed maximum wear scar areas with regard to the 3-dimensional shape and overall volume of the rock removal elements or free standing PCD bodies being used. For prior art right cylindrical rock removal elements used in drag bits, the working volume extends from one position on the circumferential edge of the right cylinder and is finally determined in use at the end of life, resulting in a maximum sized wear flat or scar. Typical observed maximum volumes for this functional working volume is 3% of the overall rock removal body. This maximum volume for the functional working volume is expected to also be the case for the embodiments of the present invention. To ensure that the physical volume of the PCD material associated with the functional working volume comprises a material with chosen high wear resistance properties, one physical volume of PCD material which completely encompasses the functional working volume may be selected. Such a physical volume may be significantly greater in volume magnitude than the typical maximum volume situation of the functional working volume, namely around 3%. This aspect may provide an important design criterion for efficient rock removal elements of some embodiments. In each case of chosen and desired shapes and geometry, the minimum proportional volume of the physical volume encompassing the functional working volume is thus around 3% of the overall volume of the free standing PCD body.

As described above, the material of the functional working volume may be chosen to have high wear resistant properties whereas in contrast the material dominating the functional support volume may be chosen to be of high stiffness and thermal conductivity. This leads to different choices of PCD material for the physical volume encompassing the functional working volume and the materials of the remaining extant support volume. Thus as the magnitude of volume of the physical volume encompassing the functional working volume exceeds 50% of the overall volume of the PCD body, its material type being optimized for high wear resistant properties, it may well compromise the desired behavior of the functional support volume. In particular, there will be a high probability that this will be the case, if the physical volume encompassing the functional working volume exceeds 50% of the volume of the overall PCD body. This leads to yet another preference, whereby the physical volume of PCD material which encompasses the functional working volume should not exceed 50% of the overall volume of the free standing PCD body. This is a feature of the invention.

Due to the absence of macroscopic residual stress, crack related performance issues in rock removal applications are expected to be of secondary importance in regard to life and efficiency of the free standing PCD rock removal bodies. As disclosed above, some embodiments may allow free standing bodies up to 150 mm in maximum dimension to be made. This then may allow, due to the absence of residual stress and the diminished probability of crack related issues, the high strength and high toughness typical of PCD materials to be exploited. In turn, this may lead to beneficial high impact resistance. In addition, the very high rigidity of PCD materials can be brought to bear. The benefits that can accrue from using large free standing bodies in general rock removal applications include aggressive presentation of the free standing PCD rock removal bodies to the rock face resulting in high rates of penetration. The high rate of penetration may come about by the large exposure resulting from the use of large PCD bodies with large functional working volumes which stand proud of the general housing body surface. High depths of penetration of the rock surface then occur and large volumes of rock can be removed for each pass or revolution of the housing body. Such large exposure of the PCD rock removal bodies is only viable due to the high strength, toughness, impact resistance and rigidity inherent in PCD material bodies with the absence of residual stress. The exposed height of the PCD body above the free surface of the housing body from the distal extremity of the functional working volume may be up to one-third of the overall dimension of the overall PCD such that the other two-thirds of this dimension may be inserted into and provide the means of attachment to the housing body.

The free standing PCD body of some embodiments may be made up of any number of physical volumes of distinct and different PCD materials, with their attendant different properties, arranged geometrically in a plethora of ways. Functionally, as already explained and described, the free standing PCD body of the embodiments is considered to comprise two volumes based upon general behavior in use, during applications of rock removal, namely the functional working volume and functional support volume. It makes sense therefore, in terms of striving to optimize the performance of the free standing body, to design the PCD body such that one physical volume of chosen PCD material is adjacent to the distal surface or free surfaces of the functional working volume and another differing physical volume of PCD material is adjacent to the proximal surface or surfaces of the functional support volume, with any number of physical volumes of PCD material separating and/or adjoining them. Due to the greater simplicity of substantially associating one physical volume of PCD material with the functional working volume and one physical volume of differing PCD material with the functional support volume, it may be beneficial to exploit only two adjoining physical volumes of differing PCD material with separating physical volume. Also, such an arrangement may have the advantage of relative ease and practicality of manufacture of only two physical volumes as opposed to multiple physical volumes. An example of such embodiments is given in FIG. 17, which also exploits a series of other preferred aspects already covered above. These embodiments are intended for use in a drag bit where predominantly a rock shearing action is required, are characterized by:

a) An overall right circular cylindrical shape, 1701.
b) The distal extremity, 1704, of the functional working volume, 1705, being one part of the circular peripheral edge, with this functional volume, determined in used, being that volume extending from this distal extremity to a flat "wear" surface, 1707, which in turn intersects the top flat surface and the curved "barrel" surface of the cylindrical body.
c) The functional support volume, 1706, being the extant part of the overall body at end of life, and thus comprising a right circular cylinder with a "wear" surface, the latter being progressively formed in use.
d) The elemental composition of the overall free standing PCD body being invariant throughout the whole body, i.e., the same metal or alloy everywhere in the body.
e) The overall free standing PCD body comprising two physical volumes, 1702 and 1703, made from different PCD materials differing in diamond grain size and size distribution.
f) The first right cylindrical physical volume of uniform PCD material, 1702, extending as a layer completely across one end of the overall cylindrical body occupying greater than 30% and no more than 50% of the overall free standing PCD body volume, 1701. The first physical volume, 1702 completely encompasses the expected functional working volume, 1705, made of a PCD material with an average diamond grain size finer than that in the second physical volume, 1703.
g) The second physical volume, 1703, extending from the first physical volume, 1702, being a right circular cylinder, occupying the remainder of the overall free standing PCD body, made of a PCD material with an average diamond grain size greater than that of the first physical volume.

A further example of embodiments exploiting two physical volumes of different PCD materials, where one physical volume is made to be significantly larger than the functional working volume, and to completely encompass the extent of the functional working volume is presented in FIG. 18. These embodiments are intended for use in roller cone drill bit bodies. The general geometric arrangement as indicated in FIG. 10*e* is exploited, being a right circular cylinder with one end extending to a general convex curved surface, most often being hemispherical. Such rock removal bodies as illustrated in FIG. 10*e* cause rock removal by predominant rock crushing and fracture mechanisms. FIG. 18 shows a cross section of a hemispherical one-ended right cylindrical shape, 1801, where the first physical volume, 1802, substantially occupies the hemispherical dome with its boundary, 1803, to the second physical volume, 1804, forming a surface which is curved and convex, 1805, to that of the hemispherical free surface. The expected final functional working volume determined in practice is demarcated by the dotted line, 1806, and the hemispherical free surface of the overall body, 1805. The first physical volume of PCD material, 1802, completely encompasses the functional working volume and the boundary between the first and second physical volumes, 1803, and is positioned remotely from the functional working volume boundary, 1806.

These embodiments, represented by FIG. 18, intended for use in roller cone bits, where predominantly a rock crushing action is required, are characterized by:

a) A single dome-ended right circular cylindrical shape, 1801.
b) The distal extremity of the functional working volume, 1807, being one part of the curved free surface of the dome, 1805, with the functional working volume,

1808, determined in use, being that volume extending from this distal extremity, 1807, to a flat "wear" surface, 1806.

c) The functional support volume, 1809, being the extant part of the overall body at end of life, and thus comprising a dome-ended right circular cylinder with a "wear flat" surface, 1806.

d) The diamond and metal network compositional ratio and the metal elemental composition of the overall free standing PCD body being invariant throughout the whole body, i.e., the same amount and type of metal or alloy in each of the two physical volumes, 1802 and 1804.

e) The overall free standing PCD body comprising two physical volumes, 1802 and 1804, made from different PCD materials differing in diamond grain size and size distribution.

f) The first physical volume of uniform PCD material, 1802, extending from the curved domed free surface, 1805, to a boundary, 1803, with the second physical volume, 1804, the boundary, 1803, being parallel to the flat base, the first physical volume, 1802, occupying greater than 3% and no more than 50% of the overall free standing PCD body volume. The first physical volume, 1802, completely encompasses the expected functional working volume, 1808, made of a PCD material with an average diamond grain size finer than that in the second physical volume, 1804.

g) The second physical volume, 1804, extending from the first physical volume, 1802, occupying the remainder of the overall free standing PCD body, 1801, made of a PCD material with an average diamond grain size greater than that of the first physical volume, 1802.

Yet another example of embodiments exploiting two physical volumes of different PCD materials, where one physical volume is made to be significantly larger than the functional working volume, and to completely encompass the extent of the functional working volume is presented in FIG. 19. Here the overall PCD body, 1901, is a right circular cylinder, 1902, where one end of the cylinder extends to a chisel shape, 1903. Specifically the shape is formed from a one-sided cone ended right circular cylinder, where two flat angled truncations, 1904, of the cone symmetrically meet at a straight edge, 1905, which may or may not be parallel to the base of the right circular cylinder. The distal extremity of the functional working volume, 1906, may be chosen to be one of the vertices or apices, 1907, where the straight edge meets the curved conical surface, 1908. Alternatively, the distal extremity may be chosen to be the full extent of the straight edge, 1905, itself. These embodiments are intended for use in drag bit or roller cone bit bodies where close to equal rock shearing and rock crushing action is required as indicated in FIG. 10*d* and are characterized by:

a) A single chisel ended right circular cylindrical shape, where the chisel shape is formed by two symmetrical angled truncations, 1904, of a cone, 1903, meeting at a straight edge, 1905, which may or may not be parallel to the base of the right cylinder.

b) The distal extremity of the functional working volume being one of the apices, 1907, formed by the straight edge, 1905, and the conical curved surface, 1908, or alternatively the distal extremity of the functional working volume may be the straight edge 1905. The functional working volume, 1906, determined in use being that volume extending from the chosen distal extremity to a "wear" surface, 1909, or alternatively the wear surface, 1910, when the distal extremity is the edge, 1905.

c) The support volume, 1911, being the extant part of the overall body at end of life, and thus comprising a chisel-ended right circular cylinder with a "wear flat" surface, 1909 or 1910.

d) The overall free standing PCD body comprising two physical volumes, 1912 and 1913, made from different PCD materials differing in diamond grain size and grain size distribution only and being invariant with respect to diamond and metal network ratio and metal elemental composition.

e) The first physical volume, 1912, of uniform PCD material extending from the straight edge, 1905, and conical curved free surface, 1908, to a boundary, 1914, with the second physical volume, 1913, occupying greater than 3% and no more than 50% of the overall free standing PCD body volume. The first physical volume, 1912, completely encompasses the expected functional working volume, 1906, made of a PCD material with an average diamond grain size finer than that in the second physical volume, 1913.

f) The second physical volume, 1913, extending from the first physical volume, 1912, occupying the remainder of the overall free standing PCD body, 1901, made of a PCD material with an average diamond grain size greater than that of the first physical volume, 1912.

The use of two or more physical volumes of different PCD materials with different and relative wear properties which are chosen to occupy the functional working volume may have a number of advantages. At least one boundary between the physical volumes will then extend into the functional working volume. As the functional working volume progressively wears away, the regions or volumes with the lower wear resistant material will wear faster than the region or volumes of the higher wear resistant materials thus resulting in the higher wear resistant PCD materials forming protrusions, ridges and shear lips at the wear scar surface. In this way, the applied load is concentrated at the protrusions, ridges and lips thereby maintaining a degree of sharpness and limiting the general load requirement for efficient rock removal. The progressive geometric increase in bluntness can then be offset, providing a mitigation of the perceived potential disadvantage of possible excessive load requirement towards the end of life of the rock removal element. A convenient, efficient and preferred means of creating one or more protruding shear lips is to employ three or more alternating layers of PCD material differing in wear resistance, which occupy the functional working volume so that the boundary or boundaries between the layers will intersect the wear flat as it progressively develops during the life of the rock removing element. A preferred means of creating wear resistance differences between physical volumes or layers of PCD material is to use diamond grain size differences for the different PCD materials, finer diamond grain sizes being typically more wear resistant than coarser diamond grain sizes. The increased scope of PCD material compositions and types over the conventional prior art, leads to a larger choice of different PCD materials over the conventional prior art, with their different wear resistance properties exploitable using these concepts. For example, in the present invention, there is a very wide independent choice of diamond grain size, metal content and metal type or elemental composition. In this way the perceived potential disadvantage of very large area wear scar surfaces can be mitigated by exploiting the increased scope and range of differentiated PCD materials which be organized to form the functional working volume. The differential wear behavior of the PCD materials in the functional working volume can lead to efficient rock removal behavior at the advanced final of life of the element.

As stated before, the free standing PCD body of the invention may be made up of any number of physical volumes of distinct and different PCD materials, with their attendant different properties, arranged geometrically in a plethora of ways. The free standing PCD body being made up of two or more physical volumes of PCD material may have the functional working volume completely encompassed by one physical volume as already discussed, or may have the functional working volume comprising two or more physical volumes such that at least one boundary between different physical volumes extends into the functional working volume.

Embodiments where three or more physical volumes occupy the functional working volume such a layered arrangement of physical volumes, where the different materials of the physical volumes give rise to differential wear and self-sharpening effects may be of particular value. In the specific case of the overall shape of the free standing PCD body being a right cylinder, appropriate structures may be formed by flat parallel layers which may or may not be parallel to the major axes of the cylinder. Alternatively, appropriate layered structures may be formed by concentric adjacent cylinders. Further, spirally rolled layers forming a classical "Swiss Roll" structure may be exploited. The layers of different PCD materials which comprise the functional working volume may be of differing or of equal thickness. However, the functional working volume may be made up of at least two physical volumes. Due to the expected practical and typical size of functional working volumes having dimensions not greater than approximately 5 mm across, this implies that in order that at least one boundary between the physical volumes extends into the functional working volume, the maximum thickness of any layer may be less than 5 mm. In order to benefit from this general set of embodiments the thickness of the layers may be such that several or more physical volumes or layers extend into the functional working volume. However, to produce a layer of material exhibiting macroscopic properties, the thickness of the layer should be greater than ten times the average grain size of the PCD material. This implies a minimum practical thickness for the PCD material layers of approximately ten times the average grain size of the PCD material.

Free standing PCD bodies where the functional working volume comprises alternating layers of differing wear resistant PCD materials providing more than one protruding ridges or lips to engender self-sharpening effects, are comprise some embodiments of the present disclosure.

As discussed above and in references 1 and 2, PCD bodies made solely of PCD material where the required metal component of the material is provided associated with the diamond starting particulate powders at the scale of the diamond powders, have an extended scope of compositions and structures as compared to the conventional prior art where the metal is provided by long range infiltration from hard metal substrate bodies. In particular the diamond grain size of such present invention PCD bodies may be chosen independently from both the metal content and elemental composition of the metal without compromising the wear resistance of the PCD material. To exploit this in the present disclosure, multiple physical volumes which alternate in dissimilar PCD material may make up the functional working volume. In this way, the progressively developing wear scar may be intersected by the boundaries between the alternating layers of dissimilar PCD materials. Alternating layers of different PCD materials is taught in patent Smallman, Adia and Lai Sang, reference 9, albeit in the prior art context of PCD bonded to hard metal substrates. The thicknesses of the alternating layers of dissimilar PCD materials may be chosen so that many boundaries intersect the developing wear scar but avoiding very thin layers where the stresses between the layers become too high. The thicknesses of the alternating layers may exceed ten times the average grain size of the PCD material. The boundaries between the alternating layers may intersect the developing wear scar surface at any chosen angle.

A particular group of valuable embodiments are based upon an overall PCD body shape of a right circular cylinder. The distal extremity of the functional working volume of these embodiments is often one part of one circumferential edge of the cylinder. A sub-group of these embodiments may be such that the functional working volume is composed of multiple alternating layered physical volumes. These layers may be diametric and parallel to the flat circular end of the cylindrical PCD body or may be arranged axially. Some axial arrangements include alternating concentric rings, and an axial spiral (e.g., "Swiss Roll"). The layered arrangements may occupy the full volume of the free standing PCD body and thereby include the functional support volume.

The prior art applied to conventional rock removal elements involving PCD material layers attached to hard metal substrates contains many patents and teachings concerned with the benefits of chamfer arrangements modifying the geometry of the PCD first applied to the rock face. Of particular note are the teachings of patent applications WO 2008/102324 and WO 2011/041693, references 5 and 6 where the benefits of the use of combinations of four types of chamfer are explained and disclosed. In the language of the present disclosure, these chamfer arrangements are modifications to the distal extremity and the free surface of the functional working volume, where the distal extremity comprises an edge. The edge forming the distal extremity may be straight or curved.

Examples of different types of chamfer as applied to embodiments of the present disclosure are defined and illustrated in FIG. 20. They are the break-in chamfer, 2004, the leading chamfer, 2003, the landing chamfer, 2005, and the trailing chamfer, 2006. For exemplary purposes, this diagram depicts an embodiment where the shape of the overall PCD body is a right circular cylinder comprising two physical volumes of different PCD materials, 2001 (PCD1), 2002 (PCD2). FIG. 20 represents a cross section of the edge of the right circular cylindrical rock removal element angled to machine a rock face, 2009. Volume PCD1 extends as a layer across the diameter of one side of the cylinder and is considered to completely encompass the functional working volume determined in use. After use at the end of life, the extant material which is the functional support volume, will comprise most of 2001 (PCD1) and 2002 (PCD2).

With reference to FIG. 20, the break-in chamfer, 2004, when the only chamfer present, is formed at the corner between the flat circular top face and the side cylindrical surface or barrel of the cylinder. This chamfer serves to prevent chipping of the PCD layer during the break-in stage of the wear progression of the rock removal element at the onset of the rock removal process. When the PCD body first contacts the rock, the distal extremity of the functional working volume is part of the circumferential edge, 2008, between the chamfer surface and the cylindrical barrel surface. If this chamfer was absent, the point of contact of the rock removal element (or the distal extremity of the functional working volume) and the rock would be sharp with a 90° included angle. The localized stress concentration at the sharp corner is high and is likely to cause chipping of the edge of the PCD body. The break-in chamfer serves to increase the included angle at the distal extremity of the working volume, at the point of contact with the rock, thereby reducing the stress concentration. Such break-in chamfers are an industry standard for rock removal elements, and are typically at an angle of 45° to the circular flat surface and also the side cylindrical surface or barrel of the cylinder. The size of the break-in chamfer may be chosen in regard to the expected hardness of the rock where small and larger size chamfers are chosen for hard to soft rocks, respectively. Typical chamfer sizes are where the depth extending from the circular flat surface to the edge of the chamfer with the cylindrical barrel surface is about 0.3 mm for hard rock and greater than 0.5 mm for softer rock formations. A free standing PCD body where the distal extremity of the functional working volume is an edge and the free surface of the functional working volume includes a break-in chamfer may be an example of a features of some embodiments.

The other chamfers, namely, leading, landing and trailing chamfers are defined with the break-in chamfer as a reference and may be used mostly in combination with a break-in chamfer. The various chamfers defined herein each play a different role during the lifetime of a rock removal element, at the various stages of the progressive wearing away of the functional working volume during the life of the free standing PCD rock removal element.

When the only chamfer present is a break-in chamfer, at the wear scar it is quickly worn away during the break-in stage of wear whence the edge between the wear scar and the top circular flat face of the rock removal element again becomes sharp. The new sharp edge again suffers the risk of chipping. Thus, a break-in chamfer only serves a limited function during the break-in stage of wear because it is worn away quickly as the wear scar progresses. The leading chamfer is designed to mitigate this problem. The leading chamfer, 2003, is formed along the top face of the rock removal element starting from the top corner of the break-in chamfer, 2004, and forms a shallow angle, b, with the flat circular face of the cylinder in FIG. 20. This shallow angle, b, typically ranges from about 10° to about 25°. The leading chamfer, 2003, serves to reduce the stress at the newly formed sharp corner when the break-in chamfer has been worn away, by increasing the included angle between the leading face of the rock removal element and the wear scar as the latter progresses. The increase in included angle also serves to keep the contact point of the PCD body and the rock to be in compression, thereby preventing the propagation of cracks which would otherwise result in chipping or spalling of the PCD body. The leading chamfer, 2003, is relatively long, typically up to about one-third to a half of the cylindrical PCD body diameter. Because of the long length of the leading chamfer, it stays active and mitigates the chipping of the PCD during the steady state stage of wear of the PCD rock removal body's life, which is most of the life.

Another problem occurs when the break-in chamfer alone is used as sharp corners are formed at the lateral ends of the wear scar when observing the wear scar face on. These sharp corners have a tendency to initiate cracks which are likely to propagate and cause spalling of the PCD body. A so-called landing chamfer mitigates the stress concentrations at the wear scar corners. A landing chamfer, 2005, is formed at the bottom edge of the break-in chamfer, 2004, and is chosen such that the angle it makes with the horizontal, which is the same as the rock face, 2009, in FIG. 20, and is equal to the rake angle of the overall PCD body to the rock face, c. The distal extremity of the functional working volume, 2008, is the edge between the break-in chamfer, 2004, and the landing chamfer, 2005, and comes into play as soon as the rock removal element or body comes into contact with the rock. It serves the function of rounding the corners of the wear scar at the early stages of wear, thereby preventing stress concentration to occur at the corners of the wear scar. This chamfer is smaller in length than the break-in chamfer and is typically of the order of 0.1 to 0.3 mm in dimension.

When the wear scar becomes large its position of intersection with the trailing cylindrical surface or barrel of the overall PCD body forms a sharp edge which is also the site of high axial tensile stress due to frictional forces and the opposite relative motion of the rock removing body and the rock face. This situation may lead to local chipping at the trailing edge of the wear scar. This problem is mitigated by providing a trailing chamfer. The trailing chamfer, 2006, is formed at the trailing edge of the landing chamfer, 2005, (or the break-in chamfer, 2004, if the landing chamfer, 2005, is not used) at a shallow angle and extends to a relatively large distance along the barrel of the cylindrical PCD body. The angle, d, the trailing chamfer, 2006, makes with the barrel of the cylinder is typically 10 to 20°.

Any one of the leading, landing and trailing chamfers described and defined above may be used individually with the break-in chamfer or any two or three of them may be combined with the break-in chamfer, depending on the need. A free standing PCD body where the free surface of the functional working volume includes a break-in chamfer and any combination of a leading chamfer, a landing chamfer and a trailing chamfer is a feature of some embodiments. A particularly useful set of embodiments exploits all four types of chamfer.

A free standing right circular cylinder is used above to define and exemplify the use of multiple chamfer arrangements and their benefit. By analogy, the chamfer types defined may be adapted and applied to more general embodiments, where the distal extremity of the functional working volume comprises an edge, said edge being straight or curved.

As indicated, chamfer arrangements at the free surface of the functional working volume can provide mitigation of undesirable chipping and spalling during break-in and steady state wear stages of the functional working volume. Another way of mitigating chipping and spalling also associated with a "chamfering effect", found experientially, is to substantially remove or deplete the metal component to a limited depth from the free surface of the functional working volume. This may be done by leaching procedures involving acid combinations capable of dissolving the metal as is well established in the art. The metal depleted layer generated by such leaching procedures may extend from the free surface of the entire functional working volume or part thereof. In the prior art which is predominantly concerned with bodies comprising a layer of PCD material asymmetrically attached to large hard metal substrates, it is necessary to mask or otherwise prevent chemical leaching agents from attacking the free surface of the hard metal substrates. Since the embodiments concern free standing PCD bodies made solely of PCD material, masking may not be necessary as conveniently the depletion or removal of the metal at the free surface of the functional working volume can be achieved by exposing the entire free surface of the free standing PCD body to the leaching agents.

The need for "masking" materials and/or devices, for protecting portions of the free standing PCD body from the leaching acids and chemical agents, although possible, may not be required. Leaching of chosen parts of the free surface of the free standing PCD body is however an option. In practice, it is technically impossible to totally remove all of the metal of the metal content in the chosen layer as small metal pools or inclusions can be completely surrounded by re-crystallized diamond and isolated from the continuous metallic network. Some residual metal is always detectable in the metal depleted layer. However, it is preferred and advantageous to cause the leaching procedures to remove as much metal as possible from the chosen layer depth so that the metal depletion approaches totality in that depth.

When the metal is substantially removed from a PCD material by processes such as chemical leaching, the material properties are significantly altered. It is believed that the wear behavior now typically takes place dominated by a grain by grain removal process in contrast to a small scale crack propagation and coalescence mechanism typical of unleached PCD material. This former mechanism is referred to as "smooth wear" and typically is a lowering of the wear resistance of the leached PCD material as compared the starting unleached PCD material. A consequence of this is that, in use, when the boundary between the leached and unleached layer intersects the wear scar free surface as the functional working volume progressively wears away, the leading edge of the rock removal element becomes "rounded" forming a chamfer like land. Since the leached layer extends from the general free surface of the functional working volume, this rounding or chamfering of the leading edge will progressively continue in concert with the progressive wearing away of the functional working volume, i.e., in concert with the progressively increasing wear scar surface. An advantageous benefit of this effect is that the leading edge is sufficiently "blunted" so that local stress concentrations are spread over slightly larger areas resulting in the inhibition of early chipping of the PCD edge. This desirable continuous "self-chamfering" effect has been observed to occur in an efficient manner for leached depths of less than ninety (90) micro meters. In particular, the use of such a limited depth of depleted metal is advantageous when PCD materials of very high wear resistance are used. PCD materials of high wear resistance by their very nature have a slow rate of development of the wear scar but are particularly susceptible to chipping as they are typically relatively hard PCD materials. When very high wear resistance PCD materials are used, the leading edge of the wear scar tends to remain very sharp. This often leads to a local very high concentration of stresses at the very sharp leading edge which may consequently easily chip. The smooth wear behavior of a leached layer of PCD material can prevent this by continuously forming a rounded leading edge. High wear resistant PCD materials are associated with fine diamond grain sizes such as when the average diamond grain size is less than ten (10) micro meters. Leached layers of PCD material, where the metal in the PCD material has been depleted approaching totality or in part, at least adjacent to the free surface of the functional working volume, which can provide a continuous rounded leading edge of the wear scar, as the functional working volume progressively wears away, is a feature of some embodiments.

This continuous self-chamfering effect will occur for all leached layers of any chosen depth which extend from the free surface of the functional working volume. However, leached layers above a certain depth, typically above ninety (90) micro meters, have been observed to engender the formation of a protruding "shear lip" in the wear scar. FIG. 21 will be used to illustrate and explain the formation of a shear lip due to the presence of a leached layer. This figure schematically shows a cross section of a wear scar, 2102, forming by the progressive wearing of a general functional working volume, 2101, of a free standing PCD body, where a boundary, 2103, between leached, 2104, and unleached, 2105, PCD material intersects the wear scar surface, 2102. Typically, a shear lip, 2106, occurs as a protruding ridge in the wear scar, 2102, at the leading edge, 2107, standing proud of the general wear scar surface, 2102. The shear lip, 2106, has been observed to stand proud of the wear scar surface, 2102, to a height of two to five times the average grain size of the PCD material. The shear lip, 2106, provides a concentration of force in an extensive wear scar area improving the efficiency of rock shearing and fracture. This is particularly valuable in some embodiments in that it leads to the potential maintenance of rate of penetration during rock drilling when the wear scar is large. Such shear lips, 2106, have been observed to occur at the wear scar surface, 2102, in the PCD leached layer, 2104, immediately above the boundary, 2103, between the leached, 2104, and unleached, 2105, PCD materials. The protruding shear lip, 2106, in the wear scar, 2102, comes about because the leached PCD material, 2104, which embodies the shear lip has been modified by local stress and temperature conditions in use to have a higher wear resistance than the unleached PCD material, 2105, immediately below it. However, the leached material immediately above the lip, 2108, which separates the material of the lip from the top, leading edge free surface, 2109, of the working volume, remains unmodified and not enhanced in wear resistance. The leached material, 2108, separating the material embodying the shear lip from the free surface, 2109, of the functional working volume remains unaltered with its low wear resistance and still provides the continuous self-chamfering effect, causing the leading edge, 2107, to be rounded as shown. It is known that under an appropriate high magnitude combination of stress and temperature that diamond can exhibit significant plastic deformation leading to "work hardening" and resultant increased wear resistance. This behaviour of diamond is reported and taught in the scientific literature, for example in C A Brookes and E J Brookes, references 10 and 11. The reported temperature at which the plastic deformation of diamond can occur is about 750° C. or above, and the stress required decreases as the temperature increases above this threshold. Such temperature conditions, however, are known to be high enough to cause thermal degradation of normal PCD materials by virtue of the presence of the typical sintering, recrystallisation aiding metals. In the literature, L E Hibbs and M Lee, reference 12, experimentally show a significant change of slope and increase in the rate of reduction of Vickers hardness at about 750° C. in experimentally determined hardness as a function of temperature data for typical PCD material with normal cobalt metal content. This increase in rate of decrease of the Vickers hardness above 750° C. was associated with thermal degradation processes of the PCD due to the presence of the cobalt metal. These conditions inevitably lead to a decrease in the wear resistance of unleached PCD material. Leached PCD materials, however, by virtue of greatly reduced metal content, have significantly improved thermal stability relative to unleached PCD materials. The depletion of metal in the leached layer allows the diamond to experience high temperatures without the thermal degradation effects being significantly operative. The dominant response of the diamond in the leached layer to the combined high stress and temperature can then be the generation of extended lattice defects such as dislocations and their "piled up" interactions resulting in a high degree of work hardening and attendant large increase in wear resistance. Thus, as illustrated in FIG. 21, where the boundary, 2103, between leached PCD material, 2104, and unleached PCD material, 2105, intersects the free wear scar surface, 2102, the leached PCD material immediately above the boundary, 2103, close to the wear scar surface, has a higher wear resistance than the unleached PCD material, 2105, below the boundary, 2103. This differential in wear resistance in the location close to the intersection of the boundary and the wear scar, can lead to the formation of a protruding shear lip immediately above the boundary. This mechanism for the generation of a shear lip can progressively occur in step with the general progression of the wear scar as the functional working volume wears away. Consequently, a continuous and desirable self-sharpening behaviour will result. This behaviour is desirable because the presence of the shear lip reduces the required load on bit for efficient rock removal at any given wear scar size. Thus when the wear scar becomes large towards the end of life of the PCD rock removing body, excessive load on bit requirement to maintain rate of penetration is mitigated and offset. In general, the presence of a layer of PCD material, extending from the surface, depleted in metal, and where a boundary between this layer and unleached PCD material intersects a wear scar surface in use, provides for the formation of a protruding shear lip during the progressive wearing away of the functional working volume.

Temperature modeling of wear scar formation in PCD materials engaged in rock removal indicates that the temperature immediately behind the wear scar surface passes through a maximum as a function of distance along the wear scar perpendicular to the leading free surface of the PCD body (V Prakash, reference 13). Typically, this temperature maximum occurs at a depth of about two hundred to five hundred (200 to 500) micro meters. Preferred embodiments would therefore be such that the boundary between leached and unleached PCD materials would be close to the position along the wear scar of this temperature maximum. The implication from this is that for particular PCD materials and particular conditions of application of a rock removal element that there exists an optimum leach depth required to best exploit shear lip formation.

When the wear resistance of the PCD material in the functional working volume is high such as the case when the average diamond grain size is less than ten (10) micron meters, the optimal leach depth for shear lip formation has been found to be in the range greater than ninety (90) micro meters and less than two hundred and fifty (250) micro meters. With a leach depth in this range, the shear lip forms early in the life of the free standing PCD rock removing element when the wear scar is still small. When the average diamond grain size of the PCD material in the functional working volume is greater than ten (10) micron meters, the wear resistance is typically such that the functional working volume can wear faster than the above case. In such cases, the optimal leach depth for shear lip formation is typically found to be in the range greater than ninety (90) micro meters and less than one thousand (1000) micro meters. This extended range of leach depth allows for lip formation for a larger wear scar area which often forms more rapidly in these cases. In all cases of leach depths where shear lip formation takes place, the leached material immediately above the shear lip between the shear lip and the free surface of the functional working volume does not experience high enough local stress and temperature conditions to be modified and thus retains the initial lower wear resistance typical of unmodified leached PCD material. The self-chamfering behaviour of this material is, therefore, always present.

It has been practically observed and taught in patent application WO 2011/041693, reference 6, that chamfer arrangements can encourage shear lip formation resulting from layers of different PCD material having different wear resistance character. This is due to the chamfer arrangement engendering appropriate applied stress at the leading edge which facilitates the shear lip formation. In particular, a combination of leading and trailing edge chamfers encourage lip formation.

There are in general, therefore, three situations which can lead to desired shear lip formation. These are layers of different PCD materials with wear resistance differential properties, a layer of metal depleted, leached PCD material adjacent to the free surface of the functional working volume and initial chamfer arrangements, respectively. These situations may be exploited independently or in any combination in order to benefit from shear lip formation.

In general, shear lips form due to local regions of enhanced and higher wear resistance relative to flanking and adjacent local regions. The general mechanism of wear involves crack initiation, propagation and coalescence related to the scale of the diamond grain size. Diamond is removed at the wear scar as single grains and/or groupings or clusters of small numbers of grains. This results in the typical protrusion height of a shear lip above the general surface of the wear scar of typically two to five times of the average grain size of the PCD material which locally has the enhanced wear resistance forming the shear lip. A free standing PCD body where a protruding shear lip forms at a wear scar during a progressive wearing away of the functional volume and stands proud of the wear scar surface to a height in the range of two to five times the average grain size of the PCD material of the local high wear resistant layer, is a feature of some embodiments.

Figure 1:
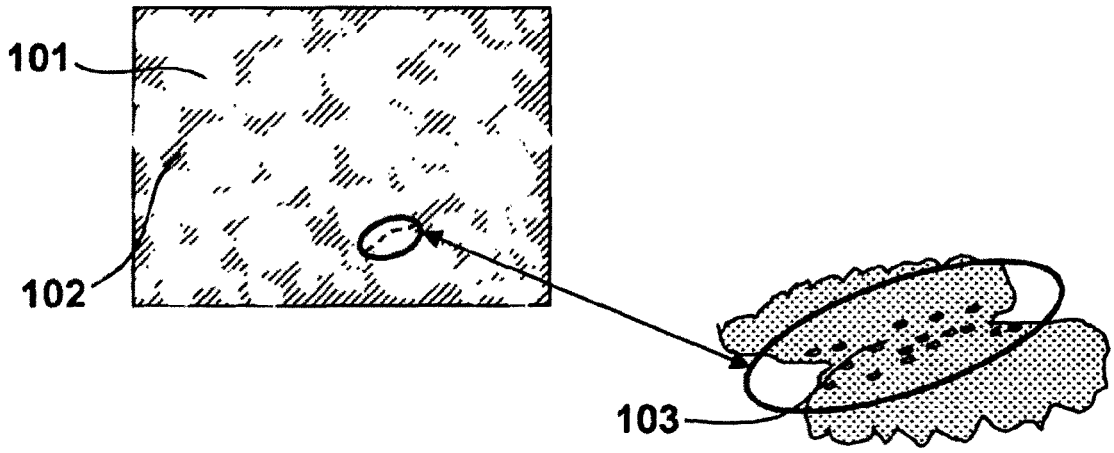
FIG. 1 is a schematic diagram of PCD intergrown network.
Figure 2:
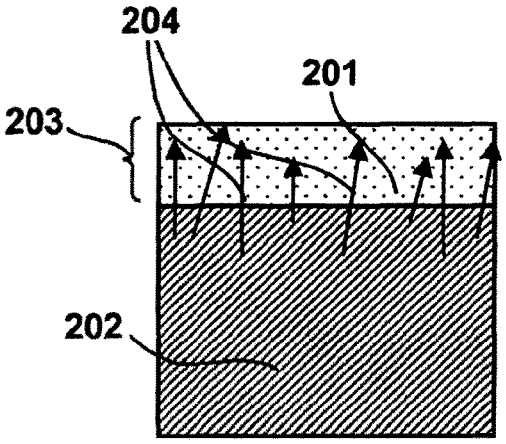
FIG. 2 is a schematic diagram of the structure of conventional PCD attached to a substrate.
Figure 3:
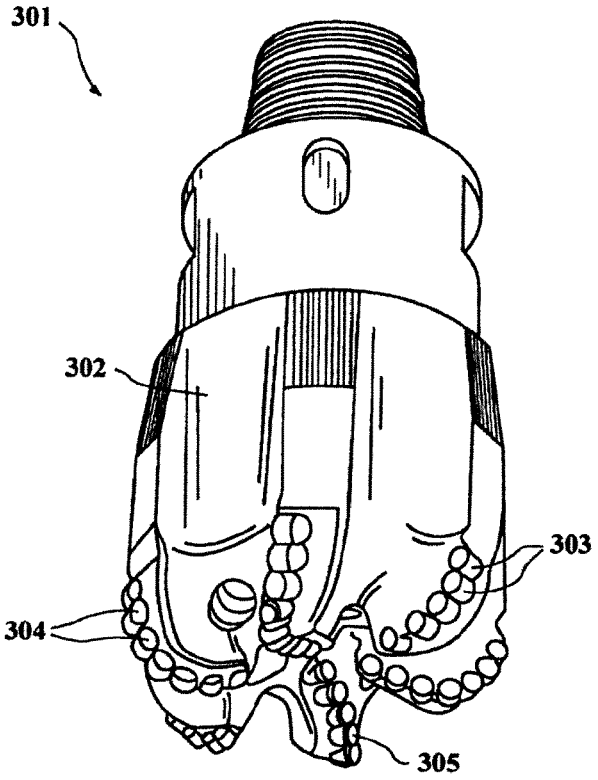
FIG. 3 is a schematic diagram of a typical drag bit and shows PCD rock removal elements.
Figure 4:
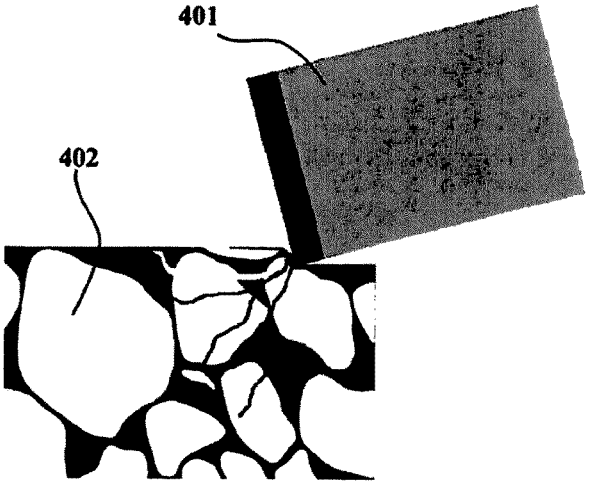
FIG. 4 is a schematic diagram showing one edge of a conventional right circular cylindrical PCD rock removal element continuously shearing rock.

A selection from the diverse embodiments of the present disclosure may be made to be collectively attached to or inserted into a housing body intended for applications where "natural rock" needs to be removed. The term "natural rock" includes all terrestrial rock formations and types such as limestone, sandstone, igneous rock, alluvial deposits and the like. The free standing PCD bodies of the various sizes, shapes and intended mix of rock removal mode behavior may be assembled and attached to housing bodies so that their relative positions and means of presentation to the rock accommodate cooperative and supportive behavior to engender efficient overall rock removal performance of the housing body. As described previously, a housing body type intended for subterranean rock drilling where the dominant rock removal mode is rock shearing is a so-called drag bit an example of which is illustrated in FIG. 3. Here, embodiments where the distal extremity of the functional volume comprises an edge and/or rounded vertex may be appropriate. For example, embodiments based on a right cylindrical overall shape where the distal extremity of the functional working volume is part of one curved circumferential edge can be attached or inserted at the larger radial positions in the drag bit housing body. Embodiments with the functional working volume formed by a general chisel shape are more appropriately attached or inserted at the smaller radial positions.

Figure 5:
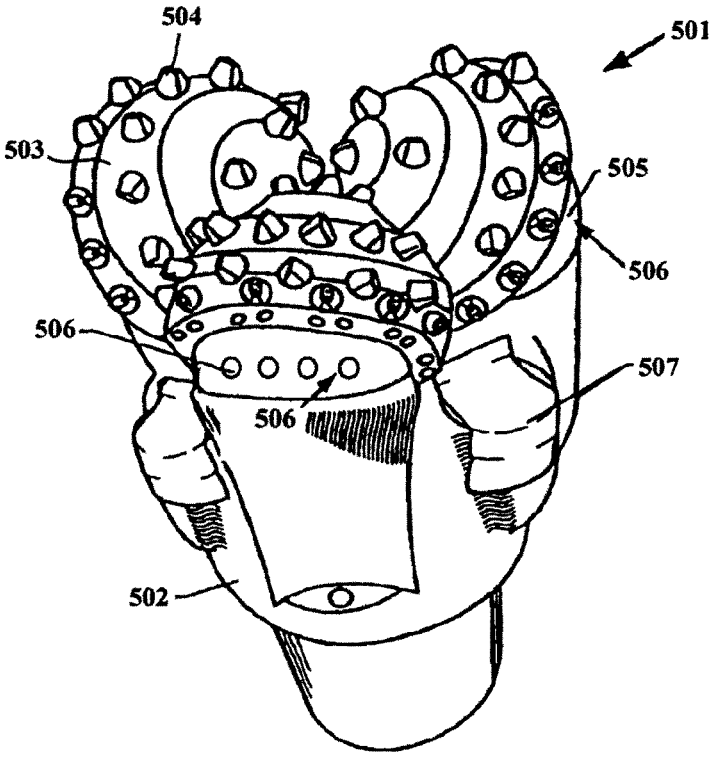
FIG. 5 is a schematic diagram of a typical roller cone drill bit where the rock removing elements are typically domed or chisel shaped structures.
Figure 6:
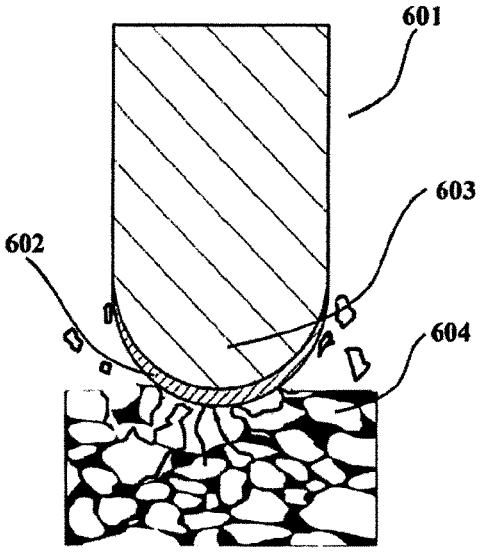
FIG. 6 is a dome shaped conventional PCD crushing element, consisting of a thin layer of PCD material forming a shell bonded to a dome shaped hard metal body, where removal of rock is by a predominantly crushing action.

As described above, a housing body type intended for subterranean rock drilling where the dominant rock removal mode is rock crushing is a so-called roller cone bit, an example of which is illustrated in FIG. 5. Here embodiments where the distal extremity of the functional volume comprises convex curved surfaces may be appropriate. For example, embodiments based on a hemi-spherical one ended right cylinder where the distal extremity of the functional working volume is the centre of the hemi spherical surface and where the right cylindrical extension from this hemi sphere is inserted or attached to the conical rollers.

In contrast to subterranean rock drilling, mining applications are concerned with rock removal where the rock removed contains specific minerals from which desirable elements can be extracted. The mineral containing natural rock removed is therefore retained and transported to sites of extraction. The housing bodies in these applications are designed so that the particular mineral containing rock is efficiently removed and retained. Typically, PCD rock removing bodies or elements are attached to so-called pick bodies which are extensions of the housing body organized in regard to the specific mineral deposit geometry or strata. Examples of minerals which may be mined using free standing PCD bodies as rock removal elements are coal, gold containing rock and, in general, minerals containing extractable metals.

In general construction applications, it is necessary to drill, shape, machine or surface natural and synthetic rock materials. These latter materials include concrete and brick in the building and construction industry and concrete, tarmacadam and general road surface materials in the road construction and maintenance industries. Free standing PCD bodies or elements for rock removal can be exploited attached and or inserted in the diverse housing bodies used for such purposes.

Any or all of the applications above where free standing PCD bodies are cooperatively and supportively arranged in the various housing body designs may exploit the feature where a high exposure of the free standing PCD rock removing element of up to a third of the maximum dimension stands proud of the free surface of the housing body.

A general method for producing free standing PCD bodies not attached to dissimilar material bodies or substrates during manufacture is taught in patent application U.S. Ser. No. 61/578,734, reference 2. The PCD bodies comprise one or more physical volumes, each a pre-selected combination of intergrown diamond grains of specific average grain size and size distribution with an independently pre-selected inter penetrating metallic network of specific atomic composition with an independently pre-selected specific overall diamond to metal ratio. Some key aspects of this general method include:

a) Forming a mass of combined diamond particles and metallic material where said mass is the sole source of metal required for diamond particle to particle bonding via partial re-crystallization,
b) Consolidating the mass of diamond particles and metallic materials to generate a cohesive green body of a pre-selected size and 3-dimensional shape,
c) Subjecting the green body to high pressure and high temperature conditions such that the metal material wholly or in part becomes molten and facilitates diamond particle to particle bonding via partial diamond re-crystallization.

The mass or masses of combined diamond particles and metallic materials may be conveniently formed by milling and mixing diamond powders with solid metallic powders to produce a homogeneous combination. One or more elemental metallic powders may be used. Metal powders which have been pre alloyed may also be used. It is usually necessary to follow the milling and mixing procedures with appropriate heat treatment in a vacuum or gaseous reductive environment in order to purify the mass. In particular, it is important to purify the mass in regard to oxides and oxygen based chemical species which typically terminate the diamond particle surfaces. Heat treatments in hydrogen, inert gas environments may be particularly useful in this regard.

Alternatively, a means of producing the mass or masses of combined diamond particles and metallic material is to use precursor chemical compounds for the metal(s). A general advantage of using such precursor compounds is that many of them are easily thermally dissociated or reduced to form finely divided and pure metals. Using precursor compounds for the metals in this way enables a superior homogeneity of combination of diamond and metal particles, particularly in cases where very fine, less than ten micron average particle size diamond powders are required. The mass or masses of combined diamond powders and metallic materials may be formed by mechanically milling and mixing the diamond particles with one or more precursor compound solid powder for the metal(s) followed by appropriate conversion or dissociation of the precursor compound or compounds to the metallic state by appropriate heat treatment. Again, heat treatment in a vacuum or gaseous reductive environment may be used.

A particular method for combining diamond particles with precursor compounds taught in the refs 1 and 2 involves suspending the diamond powder in a liquid medium and crystallizing the precursor compound or compounds in the suspension medium. The most convenient and generally useful liquid media are pure water and/or pure alcohols. This method may be done by the controlled addition of solutions of reactant compounds to the diamond particle suspension. Generally, at least one of the reactant compound solutions involves a soluble chemical compound containing the desired metal or metals. An example set of such water and/or alcohol soluble compounds are metal nitrate salts. In these cases, useful reactant solutions are of soluble alkali metal salts such as sodium carbonate, $Na_2CO_3$, and the like which are able to cause the crystallization and precipitation of metal salts as insoluble precursor compounds for those metals such as metal carbonates. Many diverse chemical reactive protocols to generate a host of useful precursor compounds for the desired metals are taught and disclosed in patent application U.S. Ser. No. 61/578,734, reference 2. These chemical protocols are included in the present disclosure by reference and all the teachings of reference 2 included for all it contains. A further aspect is where the precursor compounds nucleate and grow attached to the diamond particle surfaces so that the diamond particles become decorated in said precursor compound. On reduction or dissociation of the precursor compounds by appropriate heat treatment, the diamond particle surfaces become decorated with the specific amount of the specifically chosen metallic material. The metal particles attached to the diamond surfaces are smaller than the size of the diamond particles. This may provide a substantial advantage in that an almost perfectly uniform distribution in the combined mass of diamond particles and metallic material can be so generated, which in turn leads to a high degree of spatial compositional homogeneity in the final PCD material.

The dry purified masses of combined diamond particles and metallic material require consolidation into a cohesive, semi-dense so-called "green body" of pre-selected size and 3-dimensional shape. The size and 3-dimensional shape may be chosen to suit and to lead to the size and shape of the overall free standing PCD bodies of the embodiments. Any appropriate powder consolidation technique known in the art to form cohesive semi-dense green bodies may be used.

These include uniaxial compaction into designed appropriate size and shape moulds or preferably the use of cold or hot isostatic compaction technologies. The isostatic compaction technologies are preferable due to significantly improved spatial homogeneity of density as compared to uniaxial compaction which, in turn, leads to good spatial homogeneity in the subsequently generated free standing PCD body. When two or more physical volumes are required in any of the described embodiments, the PCD materials may be organized to differ in composition and structure so that differences in properties of the PCD materials may be exploited in different geometric positions of the overall PCD body. Many of the embodiments concern associating the different physical volumes of differing PCD materials with the two functional volumes, the working volume and the support volume. The methods for forming the chosen masses of combined diamond particles and metallic material from the patent application U.S. Ser. No. 61/578,734, reference 2, described above are possible methods for forming each of the physical volumes of the embodiments. For example, the chosen masses of combined diamond particles and metallic material for each of the physical volumes are consolidated to form cohesive green body structures. The green body structure for each of the physical volumes may be consolidated independently of one another and then assembled in the chosen geometric relation to one another to form an overall green body for each desired embodiment.

The overall green body is then subjected to high pressure and high temperature conditions such that the metal material wholly or in part becomes molten and facilitates diamond particle to particle bonding via partial recrystallization of the diamond. The high pressure and high temperature conditions taught and claimed in patent application U.S. Ser. No. 61/578,734, reference 2, are incorporated into the present disclosure by reference and generally fall in the ranges of 5 to 10 GPa pressure and 1100 to 2500° C. temperature, respectively.

Practically any free standing PCD body produced by such high pressure, high temperature processes requires final shaping, sizing and surface finishing. Any of the technologies for such purposes well known in the art may be applied to the embodiments to achieve these. These include grinding and polishing with diamond tools and abrasives, electro-discharge machining and laser ablation. Where it is necessary to use such techniques to remove significant amounts of PCD material to attain the desired shape, size and surface condition, significant and undesirable cost may be introduced. This can be mitigated if after the high pressure, high temperature processes, the resulting free standing PCD body is close in near net size and shape to what is desired. The possibility of near net size and shape for free standing PCD bodies was disclosed in patent applications U.S. Ser. No. 61/578,726 and U.S. Ser. No. 61/578,734, references 1 and 2, respectively. The basis of the near net size and shape attribute is the high degree of homogeneity of the diamond and metal masses, together with consolidation techniques capable of producing green body structures with consistency and homogeneity of density and high pressure high temperature reaction chamber designs which can provide uniform spatial shrinkage. The embodiments using the methods of manufacture disclosed may exploit these approaches and attributes to advantageously produce free standing PCD bodies with near net size and shape. In particular, combining the suspension method of combining diamond particles with precursor compounds for the metals, leading to particulate masses of homogeneous combinations of diamond particles and metals with isostatic compaction techniques for making homogeneous green body structures, leads to near net size and shape opportunities.

The generally preferred metallic materials for such diamond recrystallization is one or a combination or any permutation or alloyed combination of iron, nickel, cobalt, manganese. In particular, cobalt may often be used to form PCD materials of superior properties.

Amongst the extensive and diverse precursor compounds for the metallic composition of free standing PCD bodies are ionic salts. This grouping of precursor compounds used as milled and mixed solid powders with the diamond particles or as insoluble compounds generated in liquid media diamond particle suspensions may be particularly useful and convenient to use.

For example, metal carbonates may be used as the precursor compound or compounds as these ionic salts very readily are dissociated and reduced to pure finely divided metals.

Some embodiments are now described in more detail with reference to the following examples which are not intended to be limiting. The following examples provide further detail in connection with the embodiments described above.

EXAMPLE 1

Free standing bodies made solely of PCD material were produced. FIG. 22 is a schematic, cross-sectional representation, 2201, of this particular exemplary embodiment, intended for use in a drag bit where predominantly a rock shearing action is required. The embodiment was characterized and specified as follows.

The overall shape of each body was a right circular cylinder of finished diameter and height of 16 mm and 24 mm respectively. Using the defined method of expressing the aspect ratio of bodies as provided in the text above, the aspect ratio of these bodies was 1.5.

One circumferential edge of each cylindrical body was modified to form four chamfers, as shown in FIG. 22, namely, a break-in chamfer, 2203, a leading chamfer, 2202, a landing chamfer, 2204, and a trailing chamfer, 2205. The specifications of the four chamfers with regard to the top, flat, circular and cylindrical, barrel, free reference surfaces of the cylindrical bodies is provided in FIG. 22. The leading chamfer, 2202, made an angle of 20° with the top flat circular free surface of the body, intersected that surface at a radius of 6 mm, i.e. 2 mm in from the reference position of the cylindrical barrel. The trailing chamfer, 2205, made an angle of 10° with the reference cylindrical barrel free surface. The leading chamfer intersected the break-in chamfer, 2203, at an edge at a position 0.45 mm perpendicularly down from the top free surface reference. The break-in chamfer, 2203, intersected the landing chamfer, 2204, 0.73 mm perpendicularly down from the flat top free surface reference and the landing chamfer, 2204, intersected the trailing chamfer, 2205, 1.11 mm perpendicularly down from the flat top free surface reference respectively.

The distal extremity of the functional working volume of these bodies, 2206, was chosen to be one part of the circular circumferential edge which formed the intersection and boundary between the break-in chamfer, 2203, and landing chamfer, 2204. Thus, the first part of the bodies chosen to initially bear upon a rock surface in applications for rock removal is indicated by 2206. The functional working volume, 2207, which is the part of each PCD body which is progressively worn away in use, forming a wear flat surface, indicated by the broken line, 2208, occupies the region immediately adjacent to the position 2206, and is thus initially bounded by the chamfered free surfaces. Thus in this embodiment, the PCD bodies have one mirror plane of symmetry extending from the distal extremity position, 2206, of the functional working volume, 2207, and the distal extremity comprises a curved edge.

The functional support volume, 2209, of the PCD bodies, is that part of the bodies which is extant after use and thus forms a right circular cylindrical shape with a wear flat surface, 2208, determined at end of life or finish of use of the bodies, when the functional working volume, 2207, has been worn away.

The free standing bodies each comprised two physical volumes made of different PCD materials. One physical volume, 2210, made of PCD 1 material, extended as an 8 mm disc across one end of the right cylindrical body, 2201, with a flat boundary with the second physical body, 2211, made of PCD 2 material. The second physical volume, 2211, formed a right cylinder, 16 mm long and 16 mm in diameter. The first physical volume occupied about one third (33.3%) of the total volume of the PCD free standing body and thus occupied between 30% and no more than 50% of the overall body volume. The first physical volume, 2210, being of this size, completely encompasses the functional working volume, 2207, which is expected to have occupied no more than about 3% of the overall volume of the starting total free standing PCD body volume at chosen end of life in application. The boundary between the two physical volumes, in this way, was remote from, and did not interact with the final wear flat or boundary between the two functional volumes, indicated by the dotted line, 2208.

The two physical volumes made from different PCD materials, PCD1 and PCD2, differed in average diamond grain size and size distribution with the metal content and elemental composition being the same for each physical volume. The metal used for both physical volumes was cobalt. The elemental composition was thus invariant throughout the whole PCD body i.e., the same amount and type of metal was present everywhere in each of the bodies. The diamond grain size of the first physical volume was smaller than that of the second physical volume. The material of the first physical volume, PCD1, in each body, was uniform across the extent of the physical volume and had an average grain size of about ten (10) micro-meters formed from a multimodal combination of five separate monomodal components of diamond powder, with a cobalt content of about 9% by volume (20% by mass). The uniform material of the second physical volume, PCD2, in each body, had an average grain size of about fifteen (15) micro-meters formed from a multimodal combination of four separate monomodal components of diamond powder, with a cobalt content also of about 9% by volume (20% by mass).

The cobalt metal at the free surface of the first physical volume, 2210, including the expected free surface adjacent to the functional working volume, 2207, was removed by chemical leaching, leaving only trace amounts metal, to a depth of about three hundred (300) micrometers. This metal depleted layer is indicated in the expanded view as 2212 in FIG. 22. The free surface of the second physical volume, 2211, was not leached and contained an unaltered amount of cobalt metal.

The following steps and procedures were carried out in order to manufacture these PCD free standing bodies.

Two stock batches of particulate masses of diamond particles combined with cobalt metal were produced, one for each of the two intended physical volumes, volume 1, with PCD material 1, 2210, and volume 2, with PCD material 2, 2211.

The stock mass for volume 1, PCD material 1 was made using the following sequential steps.

100 g of diamond powder was suspended in 2.5 liters of de-ionised water. The diamond powder comprised 5 separate so-called monomodal diamond fractions each differing in average particle size. The diamond powder was thus considered to be multimodal. The 100 g of diamond powder was made up as follows: 5 g of average particle size 1.8 micro meters, 16 g of average particle size 3.5 micro meters, 7 g of average particle size 5 micro meters, 44 g of average particle size 10 micro meters and 28 g of average particle size 20 micro meters. This multimodal particle size distribution extended from about 1 micro meter to about 30 micro meters.

The diamond powder had been rendered hydrophilic by prior acid cleaning and washing in de-ionised water. To the suspension an aqueous solution of cobalt nitrate and a separate aqueous solution of sodium carbonate were simultaneously slowly added while the suspension was vigorously stirred. The cobalt nitrate solution was made by dissolving 125 grams of cobalt nitrate hexahydrate crystals, $Co(NO_3)_2.6H_2O$, in 200 ml of de-ionised water. The sodium carbonate solution is made by dissolving 45.5 g of pure anhydrous sodium carbonate, $Na_2CO_3$ in 200 ml of de-ionised water. The cobalt nitrate and sodium carbonate reacted in solution precipitating cobalt carbonate $CoCO_3$, as per the following equation, $$Co(NO_3)_2soln + Na_2CO_3soln \xrightarrow[\text{suspension}]{H_2O\ \text{diamond}} CoCO_3\downarrow + 2NaNO_3soln \quad (1)$$

In the presence of the suspended diamond powder particles, with their hydrophilic surface chemistry, the cobalt carbonate crystals nucleated and grew on the diamond particle surfaces. The cobalt carbonate precursor compound for cobalt, took the form of whisker shaped crystals decorating the diamond particle surfaces. The sodium nitrate product of reaction was removed by a few cycles of decantation and washing in de-ionised water. The powder was finally washed in pure ethyl alcohol, removed from the alcohol by decantation and dried under vacuum at 60° C.

The dried powder was then placed in an alumina ceramic boat with a loose powder depth of about 5 mm and heated in a flowing stream of argon gas containing 5% hydrogen. The top temperature of the furnace was 750° C. which was maintained for 2 hours before cooling to room temperature. This furnace treatment dissociated and reduced the cobalt carbonate precursor to form pure cobalt particles, with some carbon in solid solution decorating the surfaces of the diamond particles. In this way it was ensured that the cobalt particles were always smaller than the diamond particles with the cobalt being homogeneously distributed. The conditions of the heat treatment were chosen with reference to the standard cobalt carbon phase diagram of the literature. At 750° C. it may be seen that the solid solubility of carbon in cobalt is low. At these conditions the formation of amorphous non-diamond carbon at this temperature is low and traces of non-diamond carbon could be detected in the final diamond-metal particulate mass. The resultant powder mass of multimodal diamond particles with an overall 20 weight % of cobalt metal decorating the diamond particle surfaces, had a pale light grey appearance. The powder mass was stored under dry nitrogen in an air-tight container to prevent oxidation of the fine cobalt decorating the diamond surfaces.

The stock mass for volume 2, PCD material 2, was made using the following sequential steps.

100 g of diamond powder was suspended in 2.5 liters of de-ionised water. The diamond powder comprised 4 separate so-called monomodal diamond fractions each differing in average particle size. The diamond powder was thus considered to be multimodal. The 100 g of diamond powder was made up as follows: 5 g of average particle size 3.5 micro meters, 10 g of average particle size 10 micro meters, 20 g of average particle size 16 micro meters and 65 g of average particle size 23 micro meters. This multimodal particle size distribution extended from about 1 micro meter to about 40 micro meters.

The diamond powder had been rendered hydrophilic by prior acid cleaning and washing in de-ionised water. To the suspension an aqueous solution of cobalt nitrate and a separate aqueous solution of sodium carbonate were simultaneously slowly added while the suspension was vigorously stirred. The cobalt nitrate solution was made by dissolving 125 grams of cobalt nitrate hexahydrate crystals, $Co(NO_3)_2.6H_2O$, in 200 ml of de-ionised water. The sodium carbonate solution was made by dissolving 45.5 g of pure anhydrous sodium carbonate, $Na_2CO_3$ in 200 ml of de-ionised water. The cobalt nitrate and sodium carbonate reacted in solution precipitating cobalt carbonate $CoCO_3$, as per equation (1). In the presence of the suspended diamond powder particles, with their hydrophilic surface chemistry, the cobalt carbonate crystals nucleated and grew on the diamond particle surfaces. The cobalt carbonate precursor compound for cobalt, took the form of whisker shaped crystals decorating the diamond particle surfaces. The sodium nitrate product of reaction was removed by a few cycles of decantation and washing in de-ionised water. The powder was finally washed in pure ethyl alcohol, removed from the alcohol by decantation and dried under vacuum at 60° C.

The dried powder was then heat treated in a flowing argon, 5% hydrogen gas mixture at 750° C. in the identical manner to that of the powder for the stock mass of PCD 1 material. The resultant powder mass of multimodal diamond particles with an overall 20 weight % of cobalt metal decorating the diamond particle surfaces had a pale light grey appearance. The powder mass was stored under dry nitrogen in an air-tight container to prevent oxidation of the fine cobalt decorating the diamond surfaces.

6.8 g of the particulate mass for volume 1, PCD 1, was then pre-compacted in a uni-axial hard metal compaction die to form a semi-dense right cylindrical disc.

13.6 g of the particulate mass for volume 2, PCD 2, was then pre-compacted in a uni-axial hard metal compaction die to form a semi-dense right cylinder.

The two semi-dense bodies were then placed together and further uni-axially compacted together into a niobium metal, thin walled canister in another hard metal die-set. A second niobium cylindrical canister of slightly larger diameter was then slid over the first canister in order to surround and contain the pre-compacted powder masses. The free air in the porosities of the semi-dense compacted bodies was evacuated and the canisters sealed under vacuum using an electron beam welding system known in the art. To consolidate further, to a higher green density and to eliminate or radically reduce spatial density variations, the canister assembly was then subjected to a cold isostatic compaction procedure at a pressure of 200 MPa. Several green body assembles were produced in this manner.

Each encapsulated cylindrical green body with two physical volumes, volume 1 and volume 2, of dissimilar composition was then placed in an assembly of compactable ceramic, salt components suitable for high pressure high temperature treatment as well established in the art. The material immediately surrounding the encapsulated green body was made from very low shear strength material such as sodium chloride. This provides for the green bodies being subjected to pressures which approach a hydrostatic condition. In this way pressure gradient induced distortions of the green body may be mitigated.

The green bodies were subjected to a pressure of 6 GPa and a temperature of approximately 1560° C. for 1 hour using a belt type high pressure apparatus as well established in the art. During the end phase of the high pressure high temperature procedure the temperature was slowly reduced over several minutes to approximately 750° C., maintained at this value and then the pressure was reduced to ambient conditions. The high pressure assembly was then allowed to cool to ambient conditions before extraction from the high pressure apparatus. This procedure during the end phase of the high pressure high temperature treatment was thought to allow the surrounding salt media to remain in a plastic state during the removal of pressure and so prevent or inhibit shear forces bearing upon the now sintered PCD body. The final dimensions of the free standing PCD cylindrical body were then measured and the shrinkage was calculated to be approximately 15%.

The fully dense, right cylindrical free standing cylindrical bodies were then brought to dimensions of 16 mm diameter and 24 mm long by finishing procedure such as fine diamond grinding and polishing as well established in the art. Typical amounts of PCD material removed to attain the desired dimensions were about 0.1 to 0.3 mm.

Fine diamond grinding was then employed to form the four chamfers as specified in FIG. 22, at the end of the bodies occupied by physical volume, 2210, made of PCD material 1. A small 45° chamfer was produced at the other circumferential edge of each body, at the end of the bodies occupied by physical volume 2, 2211, made of PCD material 2.

The free surface of the top of the first physical volume, including the top flat surface and the circumferential side chamfered regions of each free standing PCD body, was then subjected to an acid leaching procedure to obtain a leached depth of about 300 micro-meters, where the cobalt metal was substantially removed. The free surface of the base and cylindrical barrel up to the beginning of the trailing edge chamfer of each PCD body was masked and prevented from being exposed to the leaching acids and thus these free surfaces remained unleached.

Due to the diamond and metal network compositional ratio and the metal elemental composition (cobalt), being invariant and the same in both the physical volumes, the elastic modulus and linear coefficient of thermal expansion coefficient of both physical volumes was deemed to be the same. Consequently, the differential elastic expansion and thermal contraction mechanisms for generating macroscopic residual stress on return to room temperature and pressure during the manufacturing process were absent.

The embodiment of Example 1 was thus deemed to be macro stress free over the dimensional span of the free standing PCD bodies. It is expected that the absence of residual stress would be evident at a scale greater than ten times the average grain size, where the coarsest component of grain size is no greater than three times the average grain size.

To confirm the absence of macro residual stress over the dimensional span of the PCD bodies, the following strain gage based procedure was carried out on an unleached sample of the free standing PCD body. FIG. 23 shows a cross section and plan view of the embodiment of this example, with the two physical volumes made of the PCD 1 and PCD 2 materials as already described. 2301, indicates a strain gage rosette which was firmly attached to the top circular free surface of the physical volume made of the PCD 1 material. A 12 mm length of the opposite end of the PCD body occupied by the PCD 2 material was then removed. This was done using a wire electro discharge machine as known in the art while suitably protecting the strain gage, the line of cutting indicated by 2302 in FIG. 23. Within the accuracy of the strain gage measuring bridge, there was no significant change in the strain related signal as compared to the pre-cut PCD body. If a significant residual stress distribution had been present, a signal would have registered in the strain gage measuring bridge. Since no significant change in the strain signal was observed, it was concluded that this embodiment was free of macro residual stress across a scale spanning the dimension of the free standing PCD body.

EXAMPLE 2

Free standing bodies made solely of PCD material were produced with the same dimensions, and overall shape as the embodiments of Example 1. FIG. 22 presents the details of this particular geometry. The chamfer arrangements and metal leached regions to a depth of about 300 micro meters remained unchanged. The embodiment of Example 2 differs from the embodiment of Example 1 in that it was made with one physical volume only. This single physical volume was made of the material of PCD1 and occupied the complete total volume of the free standing PCD bodies.

The PCD1 material had an average grain size of about ten (10) micro-meters formed from a multimodal combination of five separate monomodal components of diamond powder and had a diamond and metal network compositional ratio of 91 to 9 volume percent (80 to 20 weight percent). The metal chosen for the single physical volume was cobalt.

The chemical protocol and manufacturing steps and procedures described in Example 1 for the PCD1 material were used. 20.4 grams of the particulate diamond/cobalt metal mass was then compacted to form each cylindrical semi-dense green body using the sequential uniaxial compaction and cold isostatic compaction procedures described in Example 1. These green bodies were then subjected to a pressure of 6 GPa and a temperature of approximately 1560° C. for 1 hour using a belt type high pressure apparatus as described in Example 1. The fully dense right cylindrical free standing PCD bodies made only of PCD1 were then brought to dimensions of 16 mm diameter and 24 mm long by finishing procedures such as fine diamond grinding and polishing as established in the prior art. The four chamfer arrangement as specified in Example 1 and indicated in FIG. 22 was then formed on each of the bodies by diamond grinding and polishing procedures.

Due to the PCD free standing bodies of this embodiment comprising only one physical volume of homogeneous PCD material, it was expected that there would be an absence of macroscopic residual stress across the dimensional span of the PCD body. This was confirmed by using the strain gage based procedure as described in Example 1 as indicated in FIG. 23.

EXAMPLE 3

Free standing bodies made solely of PCD material were produced as per FIG. 24. This figure is a schematic, cross-sectional representation, 2401, of this particular exemplary embodiment, intended for use in a roller cone bit where predominantly a rock crushing action is required. The embodiment was characterized and specified as follows.

The overall shape of each body was a right circular cylinder, one end of which was formed by a hemisphere, of finished diameter and height of 16 mm and 28 mm respectively. Using the defined method of expressing the aspect ratio of bodies as provided in the text above, the aspect ratio of these bodies was 1.75.

The distal extremity, 2402, of the functional working volume, 2403, is the central position of the domed free surface. The proximal extremity, 2404, of the functional support volume, 2405, is a flat surface of diameter 25.5 mm, and the cylindrical portion, 2406, of the functional support volume, 2405, of diameter 16 mm, conically expands in cross sectional area from a height of 6.5 mm to the 25.5 mm diameter base, 2404. The conical expansion of the cross sectional area of the functional support volume, 2405, towards the proximal flat base, 2404, is intended to allow mechanical attachment to the housing body, specifically in this case the roller arrangement in the roller cone bit. The mechanical attachment may be provided by a conical mating collar arrangement such as schematically illustrated in FIG. 15*e*.

Each free standing PCD body comprised two physical volumes. The first physical volume, 2407, extending from the distal extremity, 2402, of the functional working volume, 2403, to a flat boundary, 2408, with the second physical volume, 2409, 12.4 mm along the centre line, 2410. The second physical volume, 2409, extends from said boundary, 2408, to the flat base 15.6 mm along the centre line, 2410.

In roller cone drill bits, the rock removing elements, such as 2401, the functional working volumes, 2403, are expected to wear away in use, due to cyclical dynamic contact to the rock surface being crushed. The volume worn away, 2403, is expected to be limited and completely encompassed by the first physical volume, 2407. The functional support volume, 2405, extends from the boundary of the functional working volume, 2403, to the flat based proximal extremity, 2404, and comprises most of the first physical volume, 2407, and all of the second physical volume, 2409. The functional support volume, 2409, exhibits increases in cross sectional area along the line of extension from the functional working volume, 2403, to the proximal flat base, 2404, by virtue of initially the hemispherical nature of the first part of the first physical volume, 2407, and subsequently by the conical expansion toward the proximal base, 2404. This expansion of cross sectional area engenders the principal of massive support for the functional working volume as explained above.

The intended mode of rock removal being predominantly by rock crushing requires that the rock removal element or body has a high compressive strength. This is provided in this embodiment by the free standing body being made solely of PCD material (as opposed to the conventional prior art involving layers of PCD material asymmetrically attached to hard metal substrates) and the chosen overall shape whereby the principle of massive support may be exploited.

The first physical volume, 2407, was chosen to be made of a material that exhibits a high wear resistance, in this case the same as that chosen for Example 1. The material of the first physical volume, 2407 (PCD1), in each body, was uniform across the extent of the physical volume and had an average grain size of about ten (10) micro-meters formed from a multimodal combination of five separate monomodal components of diamond powder, with a cobalt content of about 9% by volume (20% by mass).

The second physical volume, 2409, was chosen to be made of a material that exhibits a high thermal conductivity again the same as that used in Example 1. The uniform material of the second physical volume, 2409 (PCD2), in each body, had an average grain size of about fifteen (15) micro-meters formed from a multimodal combination of four separate monomodal components of diamond powder, with a cobalt content of about 9% by volume (20% by mass), the same metal content as the first physical volume. The two physical volumes, 2407 and 2409, were the same and invariant in terms of the diamond and metal network compositional ratio and metal elemental composition. Each of the two physical volumes comprised a cobalt metal composition of 9% by volume (20% by mass).

The step by step procedures described in Example 1 were carried out save that appropriately shaped and sized compaction dies were used to provide the specified shape. Again, master batches of diamond powder with diamond particles decorated in pure cobalt were produced for each of the physical volumes using the chemical protocol and cobalt carbonate precursor materials specified in Example 1.

Grinding and polishing finishing procedures well known in the art as in Example 1 were used to bring each body to final size and shape as specified in FIG. 24. Each body was then subjected to a chemical leaching procedure in hot dilute acid mixtures in order to create a limited depth layer where the metal content had been largely removed, 2411. The total free surface of each body was leached to a limited depth approaching and close to 90 micro meters. The total free surface of each body was leached, avoiding the need for masking techniques and devices and leading to simplicity and ease of manufacture. The purpose of the limited depth leach, 2411, was to engender a continuous chamfering behaviour at the edge of the wear scar formed by the wearing away of the functional working volume and in so doing limit the chances of chipping occurring around the wear scar.

EXAMPLE 4

Free standing bodies made solely of PCD material were produced as per FIG. 25. This figure is a schematic, cross-sectional representation, 2501, together with two plan views, FIGS. 25 *a* and *b*, of this particular exemplary embodiment. This embodiment was intended for use in a housing body or drill bit, at such positions in said bit, where the mode of rock removal is required to be a combination of crushing and shearing where both sub-modes are comparable in magnitude. The embodiment was characterized and specified as follows.

Figures 25A, 25B:
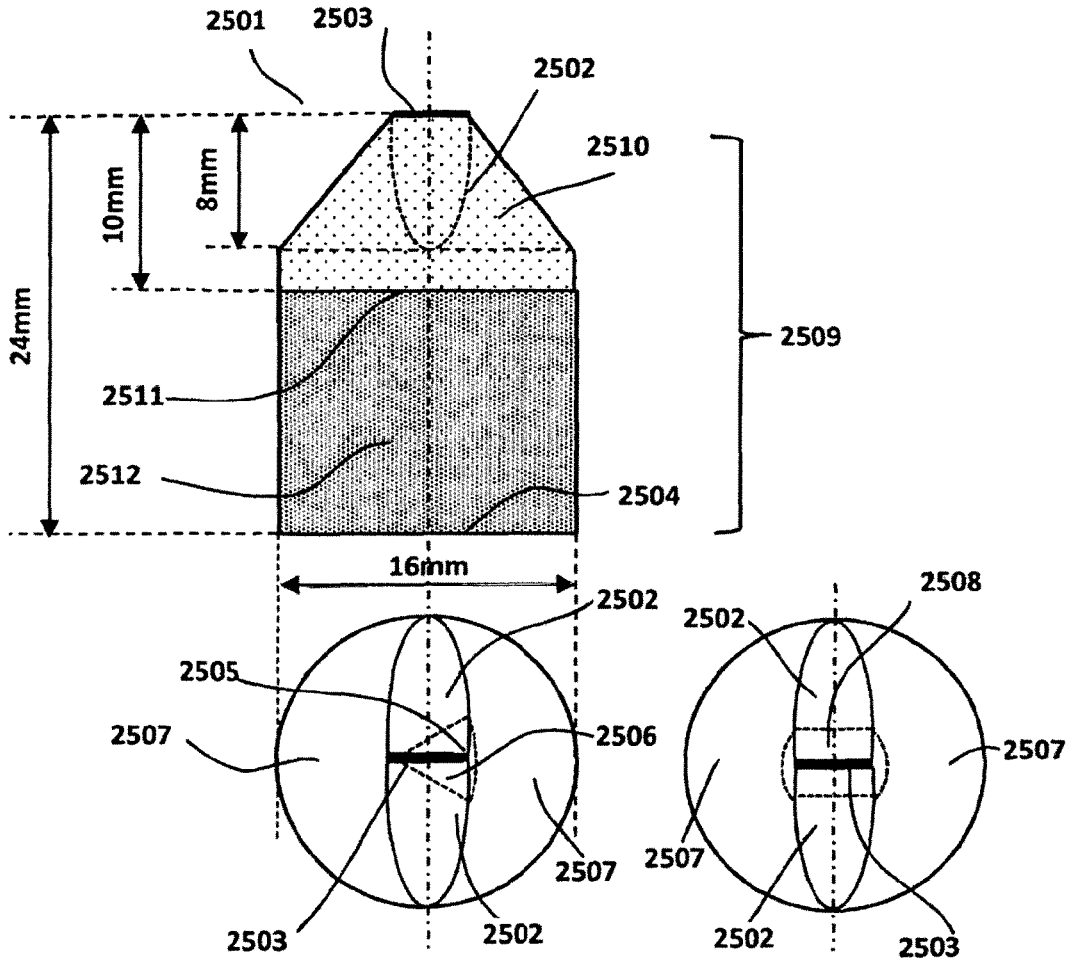

The overall shape of each body was a right circular cylinder with one end modified to be a chisel shape, made up of two symmetrical angled truncations of a cone, 2502, meeting at a straight edge, 2503. The flat truncations, 2502, extended from the edge, 2503, to the circumferential edge where the cone adjoined the cylindrical section. The straight edge, 2503, was parallel to the base of the cylinder, 2504. The distal extremity, 2505, of the working volume, 2506 may be chosen to be one of the apices, 2505, formed with the straight edge, 2503, and the conical curved surface, 2507, as shown in FIG. 25*a*. In this case the functional working volume, 2506, will wear in use to form a triangular wear flat, as indicated by the dotted lines. Alternatively the distal extremity of the functional working volume, 2508, may be the straight edge itself, 2503, as shown in FIG. 25*b*. In this case the functional working volume will wear in use to form a wear flat, as indicated by the dotted lines in FIG. 25*b*. The functional support volume, 2509, comprises the extant part in use of the truncated cone and the right cylinder extending from it.

The finished diameter and height of each body was 16 mm and 24 mm, respectively. The edge, 2503, was about 8 mm in vertical distance along the center line to the plane of the circumferential edge between the cone and the cylindrical section, as shown in FIG. 25. The edge 2503 was 4.8 mm in length and the included angle of the cone was 70°. Using the defined method of expressing the aspect ratio of bodies as provided in the text above, the aspect ratio of these bodies was 1.5.

The free standing bodies each comprised two physical volumes made of different PCD materials. The first physical volume, 2510, made of PCD 1 material, included the truncated conical volume and extended into the cylindrical section of the body and completely encompassed any chosen functional working volumes chosen and determined in use, 2506 or 2508. The vertical distance along the center line from the edge, 2503, to the boundary, 2511, with the second physical volume, 2412, was 10 mm. The boundary, 2511, with the second physical volume, 2512, was parallel with the base, 2504. It was estimated that the first physical volume occupied about 25% of the total volume of the overall body. The first physical volume, 2510, being of this size, completely encompasses the functional working volume, 2506 or 2508, either of which is expected and was chosen to occupy no more than about 3% of the overall volume of the starting total free standing PCD body, at chosen end of life in application. The boundary between the two physical volumes, 2511, in this way, was remote from, and did not interact with the final wear flat or boundary between the two functional volumes, indicated by the dotted lines, in FIG. 25*a* or FIG. 25*b*, 2506 or 2508.

The first physical volume, 2510 was chosen to be made of a material that exhibits a high wear resistance, in this case the same as that chosen for the first physical volumes of both Example 1 and 3. The material of the first physical volume, 2510 (PCD1), in each body, was uniform across the extent of the physical volume and had an average grain size of about ten (10) micro-meters formed from a multimodal combination of five separate monomodal components of diamond powder, with a cobalt content of about 9% by volume (20% by mass).

The second physical volume, 2512, was chosen to be made of a material that exhibits a high thermal conductivity, again the same as that used in both Example 1 and 3. The uniform material of the second physical volume, 2512 (PCD2), in each body, had an average grain size of about fifteen (15) micro-meters formed from a multimodal combination of four separate monomodal components of diamond powder, with a cobalt content of about 9% by volume (20% by mass).

The step by step procedures described in Example 1 were carried out save that appropriately shaped and sized compaction dies were used to provide a right cylinder extending at one end to a symmetrical cone as indicated in FIG. 25.

Again, master batches of diamond powder with diamond particles decorated in pure cobalt were produced for each of the physical volumes using the chemical protocol and cobalt carbonate precursor materials specified in Example 1.

Grinding and polishing finishing procedures well known in the art were employed to form the symmetrical, part ellipse truncations, meeting at the edge, 2503, as specified in FIG. 25.

The attachment function of the functional support volume, 2509, is provided by the right cylindrical section of each of the bodies. The options of attachment include interference fits with the housing body or bit. Low temperature brazing techniques employing special braze alloys for PCD materials known in the art may also be used.

EXAMPLE 5

Free standing bodies made solely of PCD material were produced. FIGS. 26 *a* and *b* are schematic, cross-sectional representations, 2601, of two particular exemplary embodiments where the functional working volume, 2602, consists of multiple physical volumes arranged as alternating layers, 2603, of dissimilar PCD materials. The intended use for these embodiments is for rock removal elements inserted into or attached to drag bits, where predominantly a rock shearing action is required. The overall shape of each body was a right circular cylinder of finished diameter and height of 16 mm and 24 mm respectively. Using the defined method of expressing the aspect ratio of bodies as provided in the text above, the aspect ratio of these bodies was 1.5.

Figure 26A:
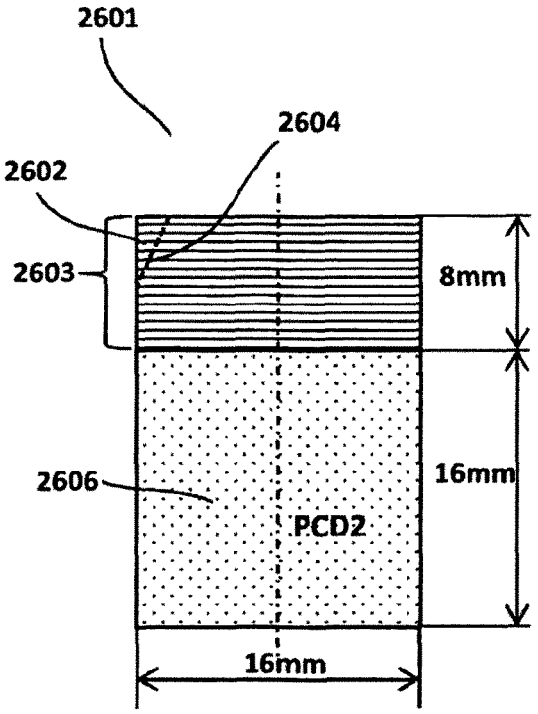

In FIG. 26*a* the alternating PCD layers, 2603, were approximately 0.5 mm in thickness, parallel to the top circular surface of the cylinder, 16 in number and extended to approximately 8 mm along the axis of the cylinder. The functional working volume, 2602, progressively formed during use would then form a wear scar, 2604, which would progressively expose multiple alternating dissimilar layers, 2603, up to possibly 10 or more layers. The dissimilar alternating layers were composed of PCD materials, PCD1 and PCD2, which were made using the same master batches of diamond and metal powder masses as used in Example 1. Namely, the material PCD1 had an average grain size of about ten (10) micro-meters formed from a multimodal combination of five separate monomodal components of diamond powder, with a cobalt content of about 9% by volume (20% by mass). The material of PCD2 had an average grain size of about fifteen (15) micro-meters formed from a multimodal combination of four separate monomodal components of diamond powder, with cobalt content again of about 9% by volume (20% by mass).

The diamond grain size of the PCD1 layers (average grain size 10 micro meters) is significantly smaller than that of the PCD2 layers (average grain size 15 micro meters), with the cobalt metal content being the same for each type of layer. The material of the PCD1 layers from previous experience is known to have a higher wear resistance than that of the material of the PCD2 layers. During the progressive wear of the functional working volume, it therefore expected that the differential wear behaviour of this alternating wear layer structure will provide multiple protruding edges or protruding lips. In turn, this would provide a continuous self-sharpening effect and mitigate the requirement of excessive load on bit to maintain efficient rate of penetration into the rock strata.

The topmost layer, adjacent to the top free surface of the free standing PCD bodies was made from the lower wear resistance PCD2 material. An advantage to the top layer being made of PCD2 material may be associated with this material typically having a wear resistance less than PCD1 material. The lower wear resistance of the top layer engenders a progressive limited "rounding" and "blunting" of the leading edge of the functional working volume which may provide the advantage of a continuous self-chamfering effect. This in turn may provide for a lower probability of deleterious chipping in use by spreading the applied load over a larger area.

Figure 26B:
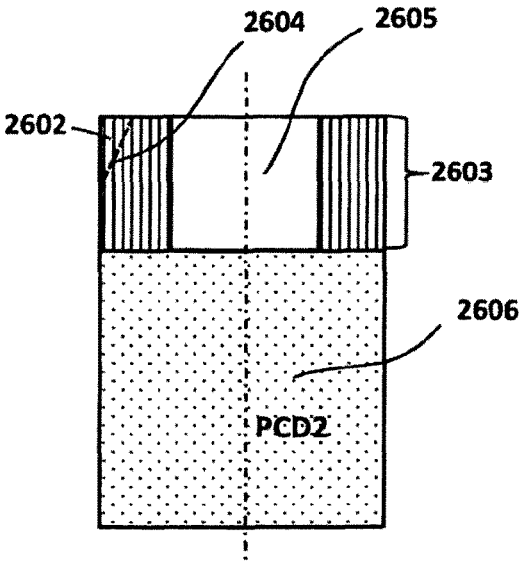

The embodiment of FIG. 26*b* had alternating PCD layers, 2603, which were approximately 0.5 mm in thickness, and arranged concentrically to the axis of the cylinder and extended to approximately 4 mm radially from the cylindrical surface of the cylindrical PCD body. The number of concentric layers was thus 8. The 8 concentric alternating layers extended about 8 mm along the axis of the cylindrical PCD body from the top surface. The concentric layers were made around a cylinder of PCD2 material, 2605. The functional working volume, 2602, progressively formed during use would then form a wear scar, 2604, which would progressively expose multiple alternating dissimilar layers, 2603, up to possibly 6 or more layers. As for the embodiment of FIG. 26*a*, the dissimilar alternating layers were composed of PCD materials, PCD1 and PCD2, which were made using the same master batches of diamond and metal powder masses as used in Example 1.

Again it was expected that each layer which was composed of PCD1 material would have a higher wear resistance than each layer composed of PCD2 material. In use, the progressive wearing away of the functional working volume should expose multiple alternating layers the differential wear behaviour of which will result in protruding edges and protruding lips providing continuous and desirable self-sharpening behaviour.

In both the embodiments of FIGS. 26*a* and 26*b*, the remaining cylindrical part of the PCD bodies, 2606, was made of one physical volume, 16 mm in length and composed of the material of PCD2. The functional support volume is thus made up of the extant part of the cylindrical body during the progressive removal of the functional working volume, 2602, and the non-layered cylindrical volume, 2606.

The master batches of the particulate masses for the materials of PCD1 and PCD2 were made using the same chemical protocols and step by step procedures as described in Example 1. Material from each of these master batches was then formed into semi-dense tapes of about 0.8 mm thickness using tape casting procedures and equipment well known in the art.

For the embodiment of FIG. 26*a*, a stack of punched discs from each of the tapes was then alternatingly arranged and the compaction, encapsulation and furnacing procedures specified in Example 1 were carried out. The resulting semi-dense green bodies were then subjected to high pressure and high temperature conditions, followed by grinding and finishing procedures as in Example 1, to form the fully dense free standing PCD bodies of the shape and dimensions given in FIG. 26*a*.

For the embodiment of FIG. 26*b*, alternating tapes of PCD1 and PCD2 materials were concentrically arranged around a green cylindrical PCD body of PCD2 material. After compaction, encapsulation, furnacing, high pressure high temperature and finishing procedures, again as in Example 1, fully dense free standing PCD bodies of the shape and dimensions given in FIG. 26*b* were formed.

REFERENCES

1. Adia, M M and Davies, G J, "A Superhard Structure or Body of Polycrystalline Diamond Containing Material", British patent application no. GB 1122064.7 and U.S. patent application No. 61/578,726.
2. Adia, M M and Davies, G J, "Methods of Forming a Superhard Structure or Body Comprising a Body of Polycrystalline Diamond Containing Material", British patent application no. GB 1122066.2 and U.S. patent application No. 61/578,734.
3. Adia M M, Davies, G J, and Bowes, C D, "A Superhard Structure and Method of Making Same", International patent application published as WO2012/089566.
4. Adia M M, Davies, G J, and Bowes, C D, "A Superhard Structure and Method of Making Same", International patent application published as WO2012/089567.
5. Tank, K, Adia, M M, Morosov, K E, "Cutting Elements", International publication no. WO 2008/102324 A1.
6. Scott, D E, Skeem, M R, Lund, J B, Liversage, J H and Adia, M M, "Cutting Elements Configured to Generate Shear Lips During Use in Cutting, Earth Boring Tools Including Such Cutting Elements and Methods of Forming and Using Such Cutting Elements and Earth Boring Tools", International publication no. WO 2011/041693 A2.
7. Bridgman, P W, 1935, Physical Review, vol. 48, pages 825-832.
8. EP0573135 B1, "Abrasive tools", Jennings, B. A., Publication of application date December 1993.
9. Smallman, C G, Adia, M M, Lai Sang, L S, "Polycrystalline Diamond Structure", application No. U.S. Ser. No. 12/962,433, application date 7 Dec. 2010. Application No. PCT/EP2010/007425 published as WO 2011/069637 application date: 7 Dec. 2010.
10. Brookes, C A and Brookes, E J, "Diamond in perspective: a review of mechanical properties of natural diamond", Diamond and Related Materials, 1, (1991), 13-17.
11. Brookes, E J, PhD Thesis, (1992), The University of Hull.
12. Hibbs, L E and Lee, M, "Some aspects of the wear of polycrystalline diamond tools in rock removal processes", Wear, vol. 46, 1978, p 141.
13. Prakash, V, "Finite Element Method for Temperature Distribution in Synthetic Diamond Cutters During Orthogonal Rock Cutting", PhD Thesis, 1986, Kansas State University, Manhattan, Kans.

The invention claimed is:

1. A cutter element for rock removal comprising:

a free standing PCD body comprising an inter penetrating network of diamond and metal, the free standing PCD body further comprising:

one or more physical volumes within the boundary of the PCD body, wherein the PCD material for the whole body is invariant in terms of the diamond and metal network compositional ratio and metal elemental composition, such that each physical volume does not differ to any other physical volume with respect to diamond and metal network compositional ratio and metal elemental composition;

a functional working volume distal to the PCD body, the functional working volume forming in use a region or volume which comes into contact with the rock and causing progressive removal of the rock by a combination of shearing, crushing and grinding and itself is progressively worn away during a lifetime of the PCD body; and a functional support volume extant in use and having a proximal free surface, the functional support volume being a region or volume extending from the functional working volume and providing mechanical and thermal support to the functional working volume together with a means of attachment of the rock removal PCD body to the housing body;

the functional working volume extending from a distal free surface or boundary between adjacent free surfaces comprising any combination of edges, vertices, convex curved surfaces or protrusions, with an increase in cross-sectional area in the functional working volume extending into the functional support volume, along a line of extension from a distal extremity of the functional working volume, through a centroid of the overall body to a proximal extremity of the functional support volume;

wherein the functional support volume encompasses the centroid of the overall free standing PCD body;

the overall PCD body having a shape having an aspect ratio such that a ratio of the length of the longest edge of a circumscribing rectangular parallelepiped of the overall PCD body to the largest width of a smallest rectangular face from which the functional working volume extends of the circumscribing rectangular parallelepiped, is greater than or equal to 1.0;

wherein the free standing PCD body is macro stress free, having an absence of residual stress at a scale greater than ten times an average grain size, where the coarsest component of grain size is no greater than three times the average grain size.

2. The cutter element of claim 1 wherein the PCD body has one mirror plane of symmetry extending from the distal free surface of the functional working volume and the distal free surface comprises a curved edge.

3. The cutter element of claim 1 where the PCD body has one mirror plane of symmetry extending from the distal extremity of the functional working volume and the distal free surface comprises a straight edge.

4. The cutter element of claim 1 where the PCD body has one mirror plane extending from the distal free surface of the functional working volume and the distal extremity comprises a vertex.

5. The cutter element of claim 1 where the PCD body has an n-fold axis of rotation through the distal free surface of the working volume and the distal free surface comprises a curved surface or has an infinite number of mirror symmetry planes extending from the distal free surface of the functional working volume.

6. The cutter element of claim 1 where the functional working volume has a general chisel shape formed by a curved surface with two or more flat surfaces or facets where the distal free surface of the working volume is formed by the boundary between the facets to be an apex, curved edge or straight edge.

7. The cutter element of claim 1 where the functional working volume has a curved surface and includes one or more flat surfaces or facets which are isolated with no common boundaries, where the distal free surface of the functional working volume is formed by a boundary between a facet and the curved surface to be a curved edge.

8. The cutter element of claim 1 where the shape of the functional support volume is a right cylinder with a circular or elliptical cross section.

9. The cutter element of claim 1 where the functional support volume is threaded at least in part.

10. The cutter element of claim 1 where the PCD material in any physical volume has a metal content which is independently pre-selected to be lower than a value y volume percent, where $y=-0.25x+10$, x being the average grain size of the PCD material in micro meter units.

11. The cutter element of claim 1 wherein:

a) the free standing PCD body comprises has an overall right circular cylindrical shape;

b) the distal free surface of the functional working volume being one part of the circular peripheral edge, with the functional working volume, as it develops in use, being that volume extending from this distal free surface to a flat "wear" surface, which in turn intersects the top flat surface and the curved "barrel" surface of the cylindrical body; and c) the support volume being the extant part of the overall body at end of life, and thus comprising a right circular cylinder with a "wear flat" surface.

12. The cutter element of claim 1 wherein:

a) the free-standing PCD body is of right circular cylindrical shape, with one end a hemi-spherical dome and the opposite end a flat base;

b) the distal free surface of the functional working volume being one part of the curved free surface of the dome, with the functional working volume, determined in use, being that volume extending from this distal extremity to a flat "wear" surface; and c) the functional support volume being the extant part of the overall body at end of life, and thus comprising a dome-ended right circular cylinder with a "wear flat" surface and the opposite end a flat base.

13. The cutter element of claim 1 wherein:

a) the free standing PCD body is of single chisel ended right circular cylindrical shape, where the chisel shape is formed by two symmetrical angled truncations of a cone, meeting at a straight edge which may or may not be parallel to the base of the right cylinder;

b) the distal free surface of the functional working volume being one of the apices formed by the straight edge and the conical curved surface or the straight edge, with the functional working volume, as it develops in use, being that volume extending from the distal free surface to a "wear" surface; and c) the support volume being the extant part of the overall body at end of life, and thus comprising a chisel-ended right circular cylinder with a "wear flat" surface.

14. The cutter element of claim 1 where the metal in the PCD material adjacent to a free surface of the functional working volume has been depleted approaching totality or in part to a controlled depth.

15. A method for producing the cutter element of claim 1 wherein the PCD body comprises one or more physical volumes, each a preselected combination of intergrown diamond grains of specific average grain size and size distribution with an independently preselected interpenetrating metallic network of specific atomic composition with an independently preselected overall metal to diamond ratio, the method comprising the steps of:

a) forming a mass of combined diamond particles and metallic material for each physical volume, where said mass is the sole source of metal required for diamond particle to particle bonding via partial diamond recrystallization;

b) consolidating each mass of diamond particles and metallic materials to generate separate cohesive green bodies of pre-selected size and 3-dimensional shape and assembling them into an overall cohesive green body, or sequentially consolidating each mass to generate an overall cohesive green body of pre-selected size and 3-dimensional shape; and c) subjecting the overall green body to high pressure and high temperature conditions such that the metal material wholly or in part becomes molten and facilitates diamond particle to particle bonding.

16. The method of claim 15 where each mass of combined diamond particles and metallic material is formed by:

I. mechanically milling and mixing the diamond particles with one or more metallic powder to produce a homogeneous combination with the diamond particles and purifying the mass by a subsequent heat treatment in a vacuum or gaseous reductive environment; or II. mechanically milling and mixing the diamond particles with one or more pre cursor compound powder for the metal to produce a homogeneous combination with the diamond particles and converting, reducing or dissociating the pre cursor compound(s) to the metallic state by a subsequent heat treatment in a vacuum or gaseous reductive environment; or III. by the steps of:

a) suspending the diamond particles in a liquid medium, b) reactively creating one or more pre cursor material(s) for the metallic material in the liquid medium by controlled addition of solutions of reactants such that the pre cursor materials nucleate and grow on the surfaces of the diamond particles as particles decorating the diamond particle surfaces, c) removing the diamond particles with their pre cursor(s) decorants from suspension, and d) subjecting the diamond pre cursor combination to a heat treatment to dissociate and reduce the pre cursor materials to form metallic materials as decorating metallic particles attached to the diamond particle surfaces.

17. The method of claim 15 wherein the cutter formed is close to a chosen and predetermined size and shape such that only surface finishing is required after high pressure and temperature processing by the steps of:

a) suspending a mass or masses of diamond particles in pure water media, b) simultaneously adding solutions of water soluble transition metal compounds and water soluble reactants to each suspension such that insoluble transition metal compounds are precipitated and nucleate and grow on the surfaces of the diamond particles as metal precursor compounds decorating the diamond surfaces, c) removing from suspension the mass or masses of diamond particles with their metals precursor surface decorating compounds and forming dry powder masses, d) subjecting the mass or masses of diamond, metal precursor combinations to heat treatments in hydrogen gas containing gaseous environment to reduce and/or dissociate the metal precursor to form a mass or masses of diamond particles, where each diamond particle is decorated with pure transition metal particles or transition metal alloy particles, e) isostatically compacting the mass or masses of diamond particles individually or in combination to form semi-dense green bodies of predetermined size and shape which are macroscopically homogeneous with respect to density at a scale greater than ten times the average diamond grain size where the coarsest component of diamond grain size is no greater than three times the average grain size, f) subjecting the green body or bodies to a pressure greater than five (5) GPa and to a temperature greater than one thousand one hundred (1100) degrees Centigrade such that the transition metals or alloy melts and partial diamond re-crystallization takes place with equal shrinkage in all spatial directions leading to fully dense PCD bodies.

* * * * *